US006766127B2

(12) United States Patent
Tanaka et al.

(10) Patent No.: US 6,766,127 B2
(45) Date of Patent: Jul. 20, 2004

(54) IMAGE FORMING APPARATUS HAVING PROCESS CARTRIDGE WITH INTERMEDIATE TRANSFER BELT

(75) Inventors: Atsushi Tanaka, Shizuoka (JP); Hiroyuki Kobayashi, Shizuoka (JP); Akihiko Nakazawa, Shizuoka (JP); Tsunenori Ashibe, Kanagawa (JP); Takashi Kusaba, Shizuoka (JP); Hidekazu Matsuda, Shizuoka (JP); Yuji Sakurai, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 6 days.

(21) Appl. No.: 10/231,034

(22) Filed: Aug. 30, 2002

(65) Prior Publication Data

US 2003/0099484 A1 May 29, 2003

(30) Foreign Application Priority Data

Aug. 31, 2001 (JP) ..... 2001-263906

(51) Int. Cl.[7] ..... G03G 21/18
(52) U.S. Cl. ..... 399/113; 399/302
(58) Field of Search ..... 399/111, 113, 399/121, 159, 302, 308

(56) References Cited

U.S. PATENT DOCUMENTS

| | | | | | |
|---|---|---|---|---|---|
| 4,873,548 | A | | 10/1989 | Kobayashi | |
| 5,331,373 | A | | 7/1994 | Nomura et al. | |
| 5,446,525 | A | | 8/1995 | Kobayashi | |
| 5,452,056 | A | | 9/1995 | Nomura et al. | |
| 5,530,532 | A | * | 6/1996 | Iino et al. | 399/237 |
| 5,585,889 | A | | 12/1996 | Shishido et al. | |
| 5,585,902 | A | | 12/1996 | Nishiuwatoko et al. | |
| 5,608,503 | A | * | 3/1997 | Fujiwara et al. | 399/302 |
| 5,713,067 | A | | 1/1998 | Mizoe et al. | 399/176 |
| 5,752,131 | A | | 5/1998 | Fujiwara et al. | 399/106 |
| 5,870,654 | A | | 2/1999 | Sato et al. | 399/109 |
| 5,887,228 | A | | 3/1999 | Motohashi et al. | 399/111 |
| 5,950,058 | A | * | 9/1999 | Kusaba et al. | 399/302 |
| 5,965,314 | A | * | 10/1999 | Herman et al. | 430/126 |
| 5,966,566 | A | | 10/1999 | Odagawa et al. | 399/109 |
| 6,078,775 | A | * | 6/2000 | Arai et al. | 399/308 |
| 6,470,165 | B2 | * | 10/2002 | Kobayashi | 399/297 |
| 6,615,015 | B2 | * | 9/2003 | Nakazawa et al. | 399/302 |
| 6,643,487 | B1 | * | 11/2003 | Shimmura | 399/302 |

FOREIGN PATENT DOCUMENTS

| | | | | | |
|---|---|---|---|---|---|
| EP | 1288741 | A2 | * | 3/2003 | G03G/21/18 |
| JP | 3-87723 | | | 4/1991 | |
| JP | 07210009 | A | * | 8/1995 | G03G/15/16 |
| JP | 08160763 | A | * | 6/1996 | G03G/15/16 |
| JP | 9-292812 | | | 11/1997 | |
| JP | 11-327316 | | | 11/1999 | |
| JP | 2000137388 | A | * | 5/2000 | G03G/15/16 |

* cited by examiner

*Primary Examiner*—Robert Beatty
(74) *Attorney, Agent, or Firm*—Fitzpatrick, Cella, Harper & Scinto

(57) ABSTRACT

A process cartridge detachably mountable on the main body of an electrophotographic apparatus, integrally supports a photosensitive drum for bearing toner images, and an intermediate transferring belt having a contact part with the photosensitive drum. The moisture amount of the intermediate transferring belt at 23° C./50% RH is less than 1% by weight and the sum of the surface roughness Ra of the photosensitive drum and the surface roughness Ra of the intermediate transferring belt is less than 0.8 $\mu$m. The present invention also provides an electrophotographic apparatus having the process cartridge and an image forming method using the electrophotographic apparatus.

15 Claims, 11 Drawing Sheets

IMAGE FORMING APPARATUS HAVING PROCESS CARTRIDGE WITH INTERMEDIATE TRANSFER BELT

BACKGROUND OF THE INVENTION

1. Field of the Invention

The present invention relates to a process cartridge, an electrophotographic apparatus and image forming method.

2. Related Background Art

As a type of a color image forming apparatus (color electrophotographic apparatus) of an electrophotographic system, there is an electrophotographic apparatus with an intermediate transferring member (intermediate transferring belt or intermediate transferring drum).

As for that apparatus, operation scheme will be described with reference to FIG. 1.

In FIG. 1, reference numeral 1 denotes a photosensitive drum (drum-shaped electrophotographic photosensitive member) as a first image bearing member, which is rotatably driven at a predetermined rotation speed (process speed) in the direction of an arrow. In addition, the photosensitive drum 1 undergoes electrifying processing uniformly at a predetermined polarity and potential with an (primary) electrifying means 2 during the rotation process, then receives exposure light 3 by an unillustrated exposing means (for example, laser beams or LEDs). Thus, an electrostatic latent image is formed corresponding to the first color component image (for example, the yellow color component image) of the target full color image. Subsequently, the electrostatic latent image is developed with the toner (yellow toner) of first developing means (yellow color developing means 41) so that a toner image (yellow component image) is formed.

The intermediate transferring belt 5 is rotatably driven at a surface speed almost equal to that of the photosensitive drum (for example, 97 to 103% based on the rotation speed of the photosensitive drum) in the direction of an arrow.

While the above described first color toner image (yellow component image) formed on the photosensitive drum 1 passes through the contact part between the photosensitive drum 1 and the intermediate transferring belt 5, transfer (primary transfer) is carried out to the external circumference face of the intermediate transferring belt 5 from the photosensitive drum 1 by a primary transferring bias applied onto the intermediate transferring belt 5 via the primary transferring means 6 from the bias battery 30. The primary transferring bias is, for example, 100 to 3,500 V.

After transferring a toner image to the intermediate transferring belt 5, transfer residual toner is removed from the photosensitive drum 1 with photosensitive drum cleaning means 13 so as to get prepared for electrifying, exposing, developing, transferring steps of the next color component.

In the same way as in the first color toner image, the second to the forth color toner images are sequentially transferred and superimposed onto the intermediate transferring belt 5. In the primary transfer step of the first to the third color, the secondary transferring means (secondary transferring roller) 7 and the electric charge producing means 9 are apart from the surface of the intermediate transferring belt 5.

After the synthesized color toner image corresponding to the target color image is formed onto the intermediate transferring belt 5, the secondary transferring means 7 is brought into contact with the intermediate transferring belt 5, a transfer medium P is conveyed to the gap between the intermediate transferring belt 5 and the secondary transferring means 7 from a sheet feeding roller 11 at a predetermined timing and that toner image is transferred to the transfer medium P (secondary transfer).

In addition, the transfer medium P having the toner image transferred thereto is introduced into a fixing means 15 to undergo heat fixing.

After completing the image transfer onto the transfer medium P, the electric charge providing means 9 is brought into contact with the intermediate transferring belt 5. For the apparatus shown in FIG. 1, a roller is used as the electric charge providing means 9.

A voltage (for example, a direct voltage+an alternating voltage) of a reverse polarity to the surface potential of the photosensitive drum 1 is applied to the roller so that transfer residual toner on the intermediate transferring belt 5 is charged to a reverse polarity opposite to the polarity of the photosensitive drum 1. The transferring residual toner charged to the reverse polarity is electrostatically transferred onto the photosensitive drum 1 from the intermediate transferring belt 5 in the contact part in contact with the photosensitive drum 1 (contact part) and in the vicinity thereof. As a result, the intermediate transferring belt 5 is cleaned (electrostatic cleaning). The foregoing is the operation scheme of the electrophotographic apparatus using an intermediate transferring belt.

In recent years, the full color electrophotographic apparatus has started spreading rapidly, but a full color electrophotographic apparatus requires more disposals as compared with a conventional monochromatic electrophotographic apparatus, giving rise to a problem of a certain inferiority in maintenance performance.

In order to solve this problem, for example, Japanese Patent Application Laid-Open No. 9-292812 proposes such a trial that an electrophotographic photosensitive member and an intermediate transferring belt are combined together into one unit to reduce the number of disposals to improve the user's jam handling performance or efficiency of replacement work of respective units. And already, process cartridges in which the electrophotographic photosensitive member and the intermediate transferring belt are combined together have been put on the market.

However, electrophotographic photosensitive members mounted on these process cartridges are belt-shaped (photosensitive belts), and therefore the size of a process cartridge itself gets larger and none can be said to be easy to replace. In addition, it is disadvantageous in reducing the size of the main body of an electrophotographic apparatus.

Therefore, the present inventors investigated a process cartridge integrally supporting an intermediate transferring belt and a photosensitive drum (an intermediate transferring belt-photosensitive drum integrated process cartridge) using a photosensitive drum.

However, in the intermediate transferring belt-photosensitive drum integral process cartridge, it was found that there was such a problem that the image density at the time of operation of the part where the photosensitive drum and the intermediate transferring belt were in contact with each other (contact part) when they were left standing was different from the image density of the other part (non-contact part) (hereinafter referred to as contact irregularity).

Moreover, it was found that the contact irregularity was apt to occur in the case of using a drum-shaped electrophotographic photosensitive member (photosensitive drum) more than in the case of using a belt-shaped electrophotographic photosensitive member (photosensitive belt).

The reasons therefore are deemed as follows.

Firstly, the following are deemed to be the reasons why the contact irregularity takes place.

Moisture in an intermediate transferring belt intensifies sensitivity in the contact part on an electrophotographic photosensitive member, giving rise to a sensitivity difference from the non-contact part, which causes dense longitudinal belts in the image to appear in a cycle corresponding to the peripheral length of the electrophotographic photosensitive member.

In addition, the following is deemed to be the reasons why the contact irregularity is apt to occur in the case of using a photosensitive drum more than in the case of using a photosensitive belt.

In the case of a photosensitive drum, the thickness of its supporting member (an aluminum cylinder is frequently used) must be made comparatively thick (for example, 0.5 to 3 mm) for maintaining its shape as a rigid material, and the electrophotographic photosensitive member cannot allow the moisture received from the intermediate transferring belt to escape through the supporting member of the electrophotographic photosensitive member.

To the contrary, the supporting member of the photosensitive belt is comparatively thin (polyester resin etc. having a thickness of 0.05 to 0.2 mm is frequently used), and hence can allow the moisture received from the intermediate transferring belt to escape through the supporting member without difficulty.

That is, if a photosensitive drum is used, it tends to be influenced directly by the moisture of the intermediate transferring belt, but if a photosensitive belt is used, the moisture is discharged to the air to a certain level through the thickness direction of the photosensitive belt, and therefore, the influence of the moisture in the contact part can be alleviated.

As described above, the present inventors have found that a photosensitive belt is more advantageous than a photosensitive drum from the contact irregularity viewpoint.

However, (1) an intermediate transferring belt-photosensitive drum integrated process cartridge is more advantageous for miniaturization,
(2) but it is difficult to drive a photosensitive belt at a constant speed with an inexpensive system, and therefore in the case of using a photosensitive belt, drive irregularity is apt to appear as density irregularity (banding) of longitudinal lines in half tone images.

On the other hand, in the case of a photosensitive drum, it is comparatively easy to keep the surface speed stable, and therefore banding is hard to cause.

Therefore, the present inventors tried to solve the problem of the contact irregularity with an intermediate transferring belt-photosensitive drum integrated process cartridge.

SUMMARY OF THE INVENTION

An object of the present invention is to provide a process cartridge in which an intermediate transferring belt and an electrophotographic photosensitive member are integrally held together, which is more miniaturized, but does not bring about image defects such as banding or coarseness, and prevents the contact irregularity from occurring to provide uniform image density, an electrophotographic apparatus having the process cartridge and an image forming method using the electrophotographic apparatus.

The present invention provides a process cartridge detachably mountable on the main body of an electrophotographic apparatus, comprising a photosensitive drum for bearing a toner image; and an intermediate transferring belt having a contact part with the photosensitive drum;

which are integrally held together, wherein the moisture amount of the intermediate transferring belt at 23° C./50% RH is less than 1% by weight and the sum of the surface roughness Ra of the photosensitive drum and the surface roughness Ra of the intermediate transferring belt is less than 0.8 $\mu$m.

In addition, the present invention provides an electrophotographic apparatus comprising:

a photosensitive drum for bearing a toner image;

a charging means for charging the photosensitive drum;

an exposing means for forming an electrostatic latent image on the photosensitive drum charged with the charging means;

a developing means for developing with a toner the electrostatic latent image formed on the photosensitive drum with the exposing means and forming a toner image onto the photosensitive drum;

an intermediate transferring belt having a contact part with the photosensitive drum for secondarily transferring onto a transfer medium the toner image having been primarily transferred from the photosensitive drum; and a primary transferring means for primarily transferring the toner image from the photosensitive drum to the intermediate transferring belt at the contact part; and comprising a process cartridge which integrally supports at least the photosensitive drum and the intermediate transferring belt and is detachably mountable on the main body of the electrophotographic apparatus, wherein the moisture amount of the intermediate transferring belt at 23° C./50% RH is less than 1% by weight, and the sum of the surface roughness Ra of the photosensitive drum and the surface roughness Ra of the intermediate transferring belt is less than 0.8 $\mu$m.

Further, the present invention provides an image forming method comprising:

an electrifying step of charging a photosensitive drum;

an exposing step of forming an electrostatic latent image on a photosensitive drum charged in the charging step;

a developing step of developing the electrostatic latent image formed on the photosensitive drum in the exposing step with a toner to form a toner image on the photosensitive drum;

a primary transferring step of primarily transferring the toner image formed in the developing step with a primary transferring means from the photosensitive drum to the intermediate transferring belt having a contact part with the photosensitive drum, and a secondary transferring step of secondarily transferring the toner image primarily transferred in the primary transferring step onto a transferring material, and using an electrophotographic apparatus having a process cartridge which integrally holds at least the photosensitive drum and the intermediate transferring belt and is detachably mountable to the main body of the electrophotographic apparatus, wherein the moisture amount of the intermediate transferring belt at 23° C./50% RH is less than 1% by weight and the sum of the surface roughness Ra of the photosensitive drum and the surface roughness Ra of the intermediate transferring belt is less than 0.8 μm.

DETAILED DESCRIPTION OF THE INVENTION

The present invention will be described in detail below.

The background under which the present invention was attained is as follows.

Normally, the installation place of an electrophotographic apparatus is mostly fixed. That is, the environments (temperature/moisture) surrounding the electrophotographic apparatus scarcely changes largely in a short time. Accordingly, in the case where a photosensitive drum and an intermediate transferring belt are separate units and the intermediate transferring belt is always attached to the main body of the electrophotographic apparatus, contact irregularity is comparatively difficult to cause.

However, in the case of an intermediate transferring belt-photosensitive drum integrated process cartridge, for example, a situation is supposed in which the wrapping bag of the process cartridge is torn and the process cartridge is incorporated into an electrophotographic apparatus beside an electrophotographic apparatus installed in a room with a comparatively low humidity. In this case, the environment in the vicinity of the process cartridge will change largely in an instant.

That is, in order to provide a process cartridge in which an intermediate transferring belt and a photosensitive drum are integrally held together, a technology is required not to lower image quality even if the surrounding environment changes in a short time.

The present inventors have already proposed in Japanese Patent Application Laid-Open No. 11-327316 that the contact-irregularity problem can be solved by reducing the moisture absorption rate of an intermediate transferring member to not more than 5% by weight. Accordingly, the present inventors used an intermediate transferring belt of a moisture absorption rate less than 5% by weight to experimentally produced an intermediate transferring belt-photosensitive drum integrated process cartridge. The process cartridge was left standing under a normal temperature and normal humidity (23° C./50% RH) environment for 24 hours and thereafter was relocated to a low temperature/low humidity (15° C./10% RH) environment and images were evaluated three hours after from the relocation. As a result, it was found that contact unevenness occurred.

Figure 4:
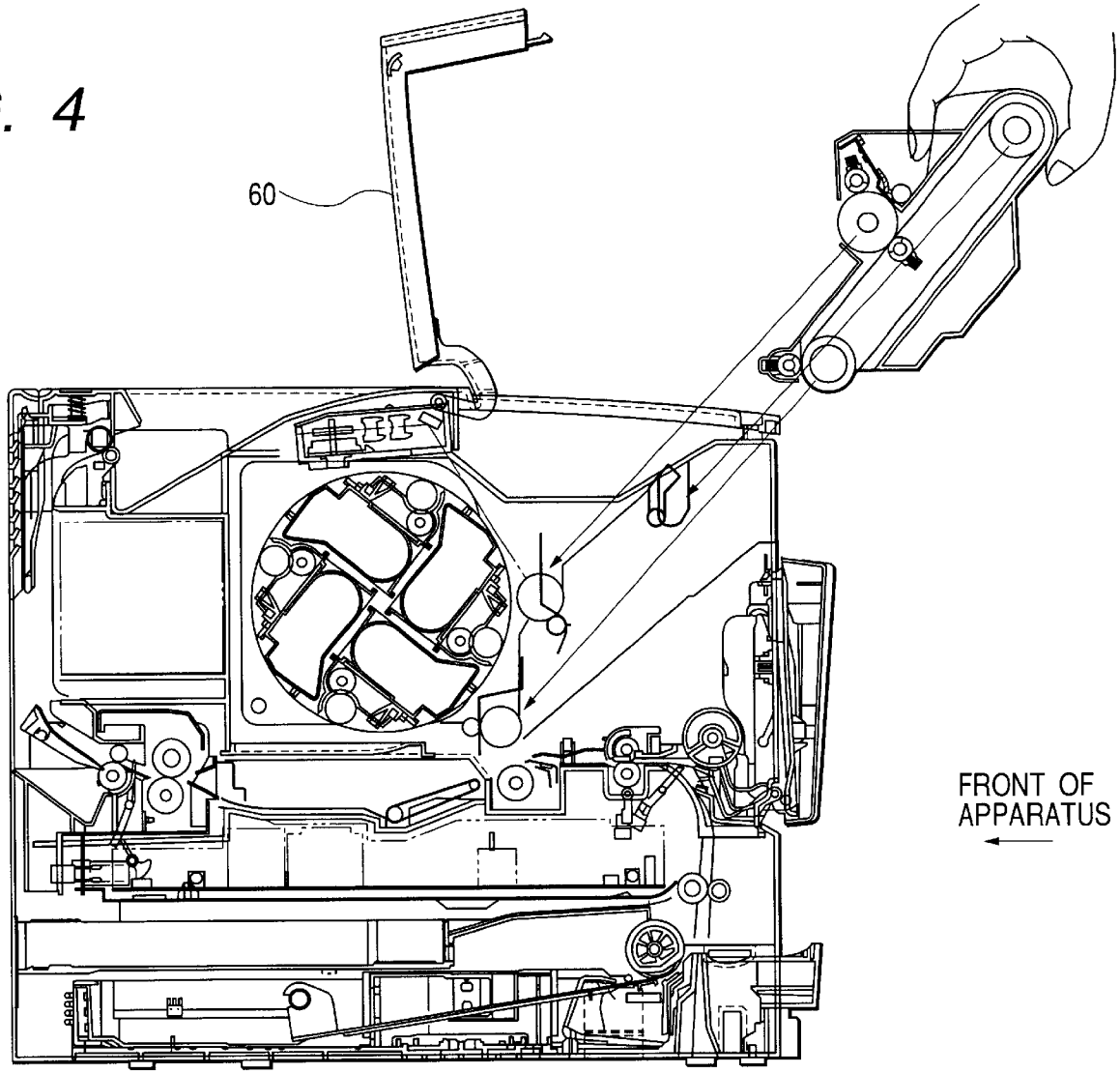
FIG. 4 depicts an electrophotographic apparatus using the process cartridge in FIG. 3.

In addition, for example, in an electrophotographic apparatus shown in FIG. 4 of the above-described publication, i.e., the electrophotographic apparatus adopting no intermediate transferring belt-photosensitive drum integrated process cartridge, the intermediate transferring belt was left standing in a low temperature-low humidity (15° C./10% RH) environment for 24 hours in a state that it was attached to the electrophotographic apparatus main body. The photosensitive drum process cartridge having the photosensitive drum having been previously left standing under a normal temperature/normal humidity (23° C./50% RH) environment for 24 hours was relocated to the low temperature/low humidity (15° C./10% RH) place where the electrophotographic apparatus was left, and immediately after the relocation, the process cartridge having the photosensitive drum was incorporated in the electrophotographic apparatus so that the photosensitive drum and the intermediate transferring belt were brought into contact with each other.

Three hours after from the contact, image evaluation was made, but no contact irregularity occurred.

That is, it was found that in the case of the electrophotographic apparatus in which the photosensitive drum and the intermediate transferring belt are not integrally held together, no contact irregularity occurred even if the image was evaluated with the same evaluation standards.

The reason for this result is deemed to be that the moisture of the intermediate transferring belt has almost no influence since the intermediate transferring belt was dry, since the intermediate transferring belt was left in advance in a low temperature/low humidity (15° C./10% RH) environment.

From the above described results, it was found that it was insufficient only to make the moisture absorption rate of the intermediate transferring belt not more than 5% by weight, and new technology would be required in order to complete a process cartridge in which the intermediate transferring belt and the photosensitive drum were integrally held together.

The following is deemed to be the reason why the contact inconstancy is apt to take place when image evaluation is made in a short time after the environment was changed.

The moisture in the photosensitive drum at the non-contact part between the photosensitive drum and the intermediate transferring belt is released to the air in a comparatively short time and the sensitivity of the photosensitive drum is lowered.

To the contrary, since the moisture contained in the photosensitive drum may be hard to release to the air, and besides, the moisture contained in the intermediate transferring belt moves to the photosensitive drum at the contact part, the state that the sensitivity of the photosensitive drum is high is maintained for a comparatively long time.

Therefore, the contact irregularity is deemed to take place when image evaluation is made in a short time after the environment is changed.

So, the present inventors tried to solve the problem of the contact irregularity by making rough the surfaces of the photosensitive drum and the intermediate transferring member and providing a minute space capable of releasing the moisture to the air also at the contact part.

Consequently, it was found that the sum of the surface coarseness Ra of the photosensitive drum and the surface coarseness Ra of the intermediate transferring belt should be not less than 0.8 μm so that the contact irregularity could be prevented.

However, when the intermediate transferring belt surface is made rough until no contact irregularity appears, it was observed to result in such a bad effect that the secondary transferring efficiency decreased and coaseness occurred in the image (particularly, a high density image expressed by superposing a plurality of color toners). That is, in the case of making the surface of the intermediate transferring belt rough, the roughness and contact irregularity are contradictory (trade off relationship), and only the control of the surface roughness of the intermediate transferring belt cannot satisfy the two.

Accordingly, a practical solution was not able to be realized by only making the surface of intermediate transferring belt rough.

In order not to cause coaseness, the sum of the surface coarseness Ra of the photosensitive drum and the surface coarseness Ra of the intermediate transferring belt is preferred to be as small as possible, and need to be less than 0.8 μm and is preferably not more than 0.5 μm and further preferably not more than 0.25 μm. On the other hand, in order not to cause the contact irregularity, not less than 0.05 μm is preferable.

In addition, as for the surface roughness Ra of the intermediate transferring belt itself, in order not to cause coaseness, less than 0.5 μm is preferable and not more than 0.2 μm is further preferable. On the other hand, in order not to cause the contact irregularity, not less than 0.03 μm is preferable.

In addition, the surface roughness Ra of the intermediate transferring belt is preferably larger than the surface coarseness Ra of the photosensitive drum.

In the present invention, the surface roughness Ra of the photosensitive drum and the intermediate transferring belt are measured as follows.

Measurement of Ra

Apparatus: Surfcorder-SE3400 (produced by Kosaka Laboratory Ltd.)

Feeding speed: 0.1 mm/second

Cut-off (λc): 0.8 mm

Evaluation length: 8 mm

Reserve length: λc×0.5

Leveling: all over square method

Sampling interval: 8,000/L

Measuring direction: axis direction (for both of the photosensitive drum and the intermediate transferring belt).

In addition, the present inventors paid their attention to the moisture amount of the intermediate transferring belt. It was based on the thought that the moisture amount contained in the intermediate transferring belt at normal temperature/normal humidity (23° C./50% RH) should be directly related to the image evaluation results rather than the moisture absorption rate (the measuring method in which an intermediate transferring belt is dipped into water is described in detail in JIS-K7209), under such a condition that image evaluation is made when three hours have passed after it is left standing for 24-hour at normal temperature/normal humidity (23° C./50% RH), and relocated into the low temperature/low humidity (15° C./10% RH) environment.

Consequently, it was found that the problem of contact irregularity did not occur with the moisture amount of the intermediate transferring belt being less than 1% by weight. The preferable range of the moisture amount of the intermediate transferring belt is not more than 0.45% by weight, and the further preferable range is not more than 0.4% by weight. The moisture amount is preferably as small as possible and 0% by weight is the most preferable.

The moisture amount in 23° C./50% RH of the present invention refers to the value measured with the following method.

Measurement of Moisture Amount (1) An intermediate transferring belt is cut and split into strips (with a width of 5 to 30 mm and a length of 10 to 50 mm) which are left standing under the normal temperature/normal humidity (23° C./50% RH) environment for 24 hours.

(2) The mass of the cut and split belt is weighed by the unit of 1 mg to be used as measurement samples.

(3) For the measuring apparatus, AQUATRAC produced by Brabender Messtechnik is used. The measuring procedure is performed according to the handling manual for the AQUATRAC. The heat setting temperature at the time of measuring is also in accordance with the handling manual for the AQUATRAC, and, for example, is set as follows. The figures indicated in the AQUATRAC relate to a weight ratio of the contained moisture to the weight of the test sample (% by weight).

Heating temperature of main resins constituting the intermediate transferring belt

| | |
|---|---|
| PC/PBT (polycarbonate/polybutylene terephthalate) | 160° C. |
| ETFE (ethylene-tetrafluoroethylene coplymer) | 160° C. |
| PC/PET (polycarbonate/polyethylene terephthalate) | 160° C. |
| PVDF (polyvinylidene fluoride) | 130° C. |
| PA (polyamide) | 160° C. |
| PC (polycarbonate) | 160° C. |
| PET (polyethylene terephthalate) | 160° C. |

Measurement of Moisture Absorption Rate

The measurement method described in JIS-K7209 was applied to this measurement.

As for the moisture absorption rate, not more than 4.1% is preferable, and also the moisture absorption rate should be preferably as small as possible and 0% is the most preferable.

Japanese Patent Application Laid-Open No. 9-292812 discloses a process cartridge in which the electrophotographic photosensitive member and the intermediate transferring belt are integrally held together, but does not go beyond the description viewed from the easy replacement performance of the process cartridge and jam handling, and does not state not only solution means by way of moisture amount and surface roughness are not described, but also even the fact that the technological problems are different between the case where a photosensitive drum is used and for the case where a photosensitive belt is used.

In addition, Japanese Patent Application Laid-Open No. 3087723 indicates that the moisture amount of the seamless belt should be preferably not more than 0.5% by weight, but ends only by describing very general matters concerning handling (at the time of manufacturing and at the time of storage) of resin molding products. In addition, this publication has not described at all how the surface roughness and moisture amount influence image quality and the like.

The present inventors found, as a result of further investigation, that when the intermediate transferring belt with a moisture amount of less than 1% by weight is used for the process cartridge further having electric charge providing means and photosensitive drum cleaning means, not only the contact irregularity in the contact part between the intermediate transferring belt and the photosensitive, drum but also the contact irregularity in the contact part between the intermediate transferring belt and the electric charge providing means can be prevented from occurring and is preferable. In the case where the electric charge providing means are a roller type (electric charge giving roller), that effect is particularly remarkable.

The electric charge providing means is a means for providing the toner on the intermediate transferring belt with an electric charge of a polarity reverse to the polarity of the toner at the time of the primary transfer in order to return the toner on the intermediate transferring belt (transferring residual toner) to the photosensitive drum in the contact part between the intermediate transferring belt and the photosensitive drum to clean the intermediate transferring belt, and a photosensitive drum cleaning means is a means for cleaning the toner on the photosensitive drum (the toner that did not undergo primary transfer onto the intermediate transferring belt and the above described transferring residual toner returned from the intermediate transferring belt).

The reason for using this arrangement is deemed to be that the moisture of the intermediate transferring belt may be hard to release to the air also in the contact part between the intermediate transferring belt and the electric charge providing means as the contact part between the intermediate transferring belt and the photosensitive drum, and therefore the resistance value of the intermediate transferring belt in the contact part with the electric charge providing means becomes lower than that in the non-contact part.

Moreover, the present inventors have found that if the resistance irregularity of the volume resistivity in the periphery direction of the intermediate transferring belt was less than 100, the contact irregularity was hard to bring about and it was preferable.

The reason why if the resistance irregularity of the volume resistivity in the periphery direction is large, the contact irregularity is hard to bring about, is deemed to be as follows.

That is, the large resistance irregularity proves that a portion with a low resistance is locally present, and in such a portion, a conductive agent exists densely. In general, a conductive agent has such a feature that it tends to absorb moisture. Therefore, the portion with a low resistance is deemed to get a larger moisture amount so that the contact irregularity is apt to occur.

In the present invention, the resistance irregularity of the volume resistivity in the periphery direction refers to values measured with the following method.

Measuring Device

Resistance meter: Super high resistometer R8340A (produced by Advantest)

Test sample box: Super high resistance meter measurement test sample box TR42 (produced by Advantest)

(a main electrode with a diameter of 22 mm, and a guard ring electrode with an inner diameter of 41 mm and an outer diameter of 49 mm.)

Sample

Eight sheets of circular pieces with a diameter of 56 mm in the periphery direction are cut out of the central part in the axis direction of the intermediate transferring belt. At this time, the eight pieces are cut at phases of 45°. One face of each of the cut test sample pieces is provided with an electrode all over its face with a Pt—Pd evaporation film, and the other face is provided with a main electrode having a diameter of 25 mm and a guard ring electrode having an inner diameter of 38 mm and an outer diameter of 50 mm with a Pt—Pd evaporation film. The main electrode and the guard ring electrode are on a concentric circle. The Pt—Pd evaporation film is obtained by carrying out an evaporation operation for two minutes with the mild sputter E1030 (produced by Hitachi Manufacturing). Those having been subjected to the evapolation operation are used as measuring samples.

Measuring Conditions

Measuring atmosphere: normal temperature/normal humidity (23° C./50% RH)

(Measuring samples are left standing in advance in the measuring atmosphere for 24 hours.)

Measuring mode: program mode 5 (charging and measuring for 30 seconds, and discharging for 10 seconds)

Applying voltage: 1 to 1,000 (V)

The applying voltage can be selected from any of 1 to 1,000 V, which is part of the voltage range applied to the intermediate transferring belt used in the electrophotographic apparatus of the present invention. In addition, according to the resistance, the thickness, and the dielectric breakdown strength of the sample, within the range of the above described applying voltage, the applying voltage at the time of measuring can be timely changed.

All of the eight measuring samples are measured, and the ratio of the maximum value to the minimum value of the measurement results (maximum value/minimum value) is defined as the resistance irregularity of the volume resistivity in the peripheral direction.

The intermediate transferring belt of the present invention may be comprised of a single layer or two layers or more. When obtaining a multi-layer intermediate transferring belt, it may be obtained by extrusion from a multi-layer die, or by extruding a single layer tube and thereafter adding a new layer (for example, laminate, spray coating, dipping coating etc.) to the front face or the rear face of the tube.

The thickness of the intermediate transferring belt of the present invention is preferably 50 to 200 μm, and more preferably 60 to 160 μm. With less than 50 μm, the belt is short of mechanical intensity (tension intensity) and tends to be torn during use. With a thickness of more than 200 μm, the absolute value of moisture held by the belt becomes too large, and the contact irregularity is apt to occur easily.

As the photosensitive drum used in the process cartridge of the present invention there may be used a photosensitive drum containing non-metal phthalocyanine, gallium phthalocyanine, oxy-titanium phthalocyanine, azo compound, etc. in the electric charge producing layer. Of course, the materials will not be limited to them.

The intermediate transferring belt of the present invention is preferably manufactured by the use of resin, rubber or elastomer. In particular, from the anti-creeping performance viewpoint, resin is preferable.

Resin can be roughly divided into thermosetting resin and thermoplastic resin, but in general, since heat hardening resin is harder than thermoplastic resin, scratches on the photosensitive drum may occur in the contact part with the photosensitive drum. In particular, in the constitution of the present invention in which the photosensitive drum and the intermediate transferring belt are integrally held together, the intermediate transferring belt is preferably manufactured by the use of thermoplastic resin.

As examples of preferable thermoplastic resin, polyvinylidene fluoride, the following may be named: vinylidene fluoride copolymer, polyester (for example, polyethylene terephthalate and polybutylene terephthalate, etc.), polycarbonate, acrylic copolymer, polyolefin (for example, polyethylene and polypropylene) and polyamide or a mixture thereof. Of course, the materials will not be limited to them.

In order to adjust the resistance value of the intermediate transferring belt, a conductive agent will be required, but from the resistance irregularity viewpoint, an organic conductive agent is preferable. However, in general, the organic conductive agent causes a large change in resistance values depending on environments (moisture in particular), and the amount of moisture is also large, and attention must be paid.

As examples of preferable conductive agents, polyetheresteramide, polyetherester, polyetheramide, etc. may be named. Any salts may be added.

Of course, as the conductive agent, fillers such as carbon black and metal oxides etc. may be used. However, in this case, the filler is difficult to uniformly disperse, the resistance irregularity of the intermediate transferring belt is apt to occur and attention must be paid.

The particle diameter of the filler is preferably 0.05 to 2 μm in primary particle diameter. Such particle diameter can be obtained by splitting the produced belt and observing the section with a Scanning Electron Microscope (SEM) or a Transmission Electron Microscopy (TEM).

In further detail, ten particles are selected within any visual field, and the diameters of circumscribed circles of the selected particles are found, and the average value of the diameters of the found circumscribed circles is regarded as the primary particle diameter. The SEM is preferably used when the average particle diameter is not less than 0.1 μm and the TEM is preferably used when the average particle diameter is less than 0.1 μm.

As an example of a preferable manufacturing method for obtaining the intermediate transferring belt of the present invention, a method, which is known as the so-called inflation method (also called as blown film extrusion molding, or tubular film extrusion molding), may be named in which molding is continuously carried out while inflating a tube by blowing a gas at atmospheric pressure or more inside the tube at the time of extrusion in tube form from the tip of a cylindrical dice with an extruder.

In addition, in particular, if a sandwiching member having the width of not less than half a peripheral length of the tube sandwiches in its entire width the tube while crushing it in the transverse direction (TD) and draws out the tube, the lay flat width of the film, i.e., the belt peripheral length, is stabilized, which is preferable. In addition, the inflation method, which is a kind of molding method for continuously drawing out tubular melt materials, enables the intermediate transferring belt to be continuously produced, and can manufacture the intermediate transferring belts at a low price.

Moreover, a double-screw extruder is used as an extruder for extruding tubular melt materials, whereby dispersion and mixture of materials can be performed well, so that labor for the dispersion step can be saved. In addition, resistance changes due to dispersion irregularity become small and the contact irregularity is hard to bring about, which is preferable.

Figure 11:
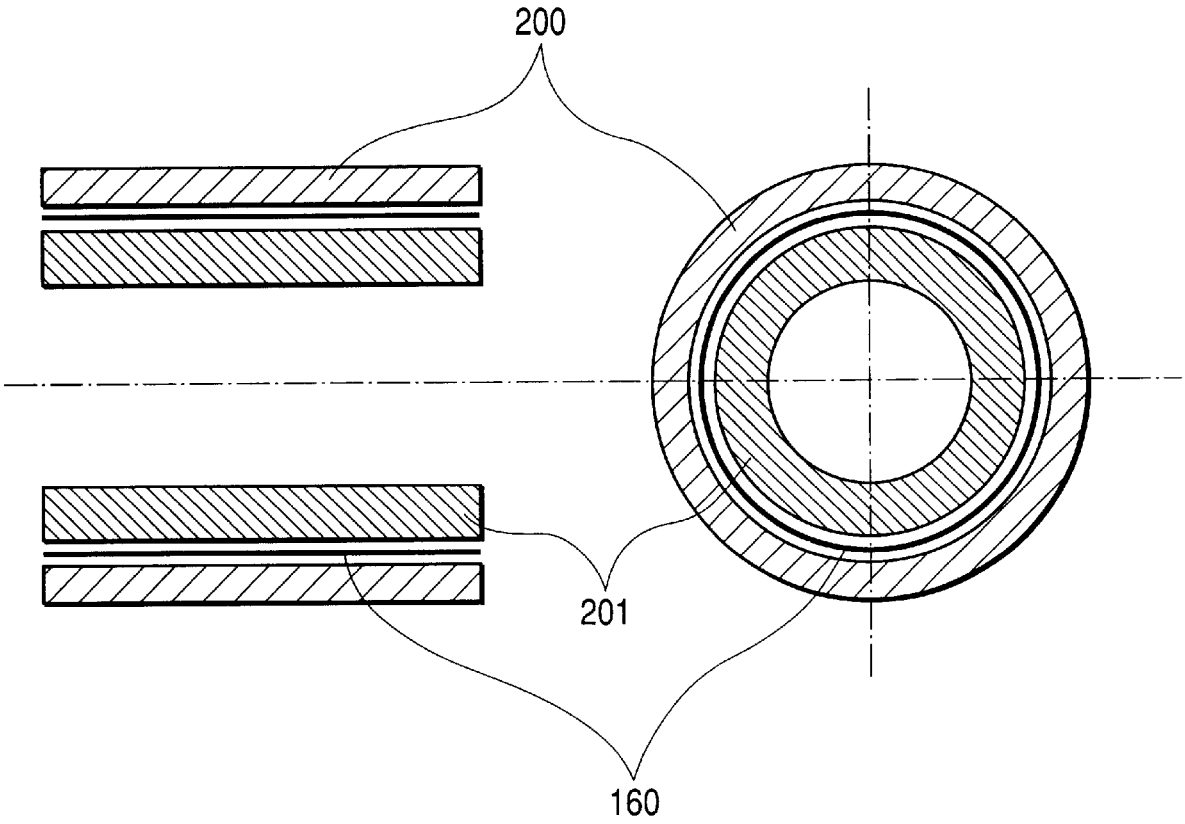
FIG. 11 is a view showing the processing in which a tube mold is used.

When a sandwiching member (pinch roll) sandwiches in its entire width the tubular melt extruded from the circular die and draws it out, a crease caused by the pinch roll may be left in the intermediate transferring belt. In this case, the tube (tube 160) obtained in the above described manufacturing method is attached to the gap between an internal mold 201 and an external mold 200, respectively, made of materials having different thermal expansion coefficients and the tube is heated and cooled together with the above described molds so that the crease can be removed. In addition, the roughness of the inner face of the external mold 200 is changed so that the surface roughness of the tube is made to a desired value (FIG. 11).

According to Examples and Comparative Examples, embodiments of the present invention will be described in further detail.

EXAMPLE 1

The following materials were mixed with a double-screw extruder to obtain a pellet.

Polyvinyliden fluoride resin (PVDF) 73% by weight

Polyetheresteramide (conductive agent: Pelestat NC6321: Produced by Sanyo Chemical Industries, Ltd.) 7% by weight Kaolin (primary particle diameter of 2 μm) 5% by weight Zinc oxide (primary particle diameter of 0.2 μm) 15% by weight The obtained pellet was dried at 100° C. for two hours and was fed into a hopper 110 of the extruder 100 shown in FIG. 2. The temperature of the extruder 100 was set at 180 to 210° C. The pellet fed from the hopper 110 was introduced into a circular die of a die-lip diameter (D1=100 mm, die gap 300 μm) and extruded out of the circular die in tube from. In addition, with the air supplied from a gas intake path 150, the tube 160 was expanded. The diameter D2 of the tube 160 after expansion was 140 mm.

The tube 160 was gradually crushed with a stable plate 170 and was drawn out upward. The drive source for drawing out was a pinch roll 180. The width of the roll was 600 mm. The tube 160 was crushed with this roll. Therefore, the air introduced to the inside of the tube 160 did not leak outside the tube. Accordingly, once the air was taken in, the diameter of the tube 160 was stabilized without any air being introduced from the gas intake path 150.

Figure 2:
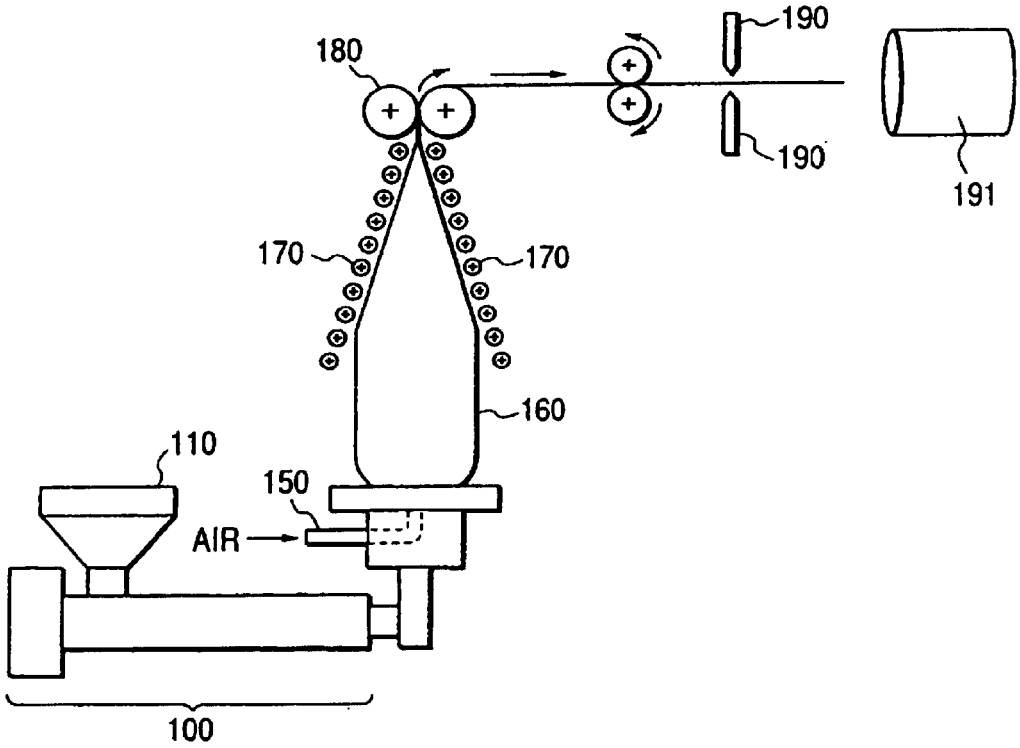
FIG. 2 is a schematic view of a tube molding extruder.

The tube 160 after passing through the pinch roll 180 was shaped into a folded tube with a lay flat width of 220 mm. Thereafter, it was cut with a cutter 190 cut intermittently at an angle of the tube's machine direction (MD)±10° so that tubes with a thickness of 150 μm and a width (length) of 300 mm were obtained. In FIG. 2, reference numeral 191 denotes a tube in a folded state after being cut with cutter 190.

Next, the obtained tube was caused to cover the center part of the aluminum cylinder of an external diameter of 142.00 mm and a length of 330 mm to become an inner mold. Moreover, a stainless cylinder (surface roughness Ra=0.123 μm), which was to be an external mold, of an inner diameter of 142.31 mm and a length of 330 mm subjected to honing processing in the inner peripheral face with a #150 sandpaper was brought into engagement outside the tube and was heated at 170° C. After the heating, the cylinder was cooled to 30° C. in the state of engagement, then the stainless cylinder as well as the aluminum cylinder were removed to produce a belt of a diameter of 140 mm and a width of 300 mm.

The above described secondary processing was finished to such a level that the crease (ascribable to the pinch roll) of the tube could not be distinguished by visual detection. The surface roughness Ra of the intermediate transferring belt was Ra=0.123 μm.

The obtained belt was cut into belt pieces having a width of 240 mm, and a meandering-prevention guide (rib) was attached to the inner periphery face of one end so that the intermediate transferring belt of the present invention with a thickness of 100 μm was obtained.

The resistance irregularity of the volume resistivity in the periphery direction of the obtained belt was 6.6 while the average value of the volume resistivity was $2\times10^{11}$ Ω.cm.

According to the above described measuring method, the moisture amount of the intermediate transferring belt was measured to reveal that the moisture amount was 0.225% by weight. Measurement of the moisture amount was conducted at 130° C.

According to the measuring method described in JIS-K7209, the moisture absorption rate was measured to reveal that the rate was 3.6% by weight.

When measuring the volume resistivity, the moisture amount and the moisture absorption rate, the measurement was made with the rib being cut out so as to be excluded from the measuring samples.

Figure 3:
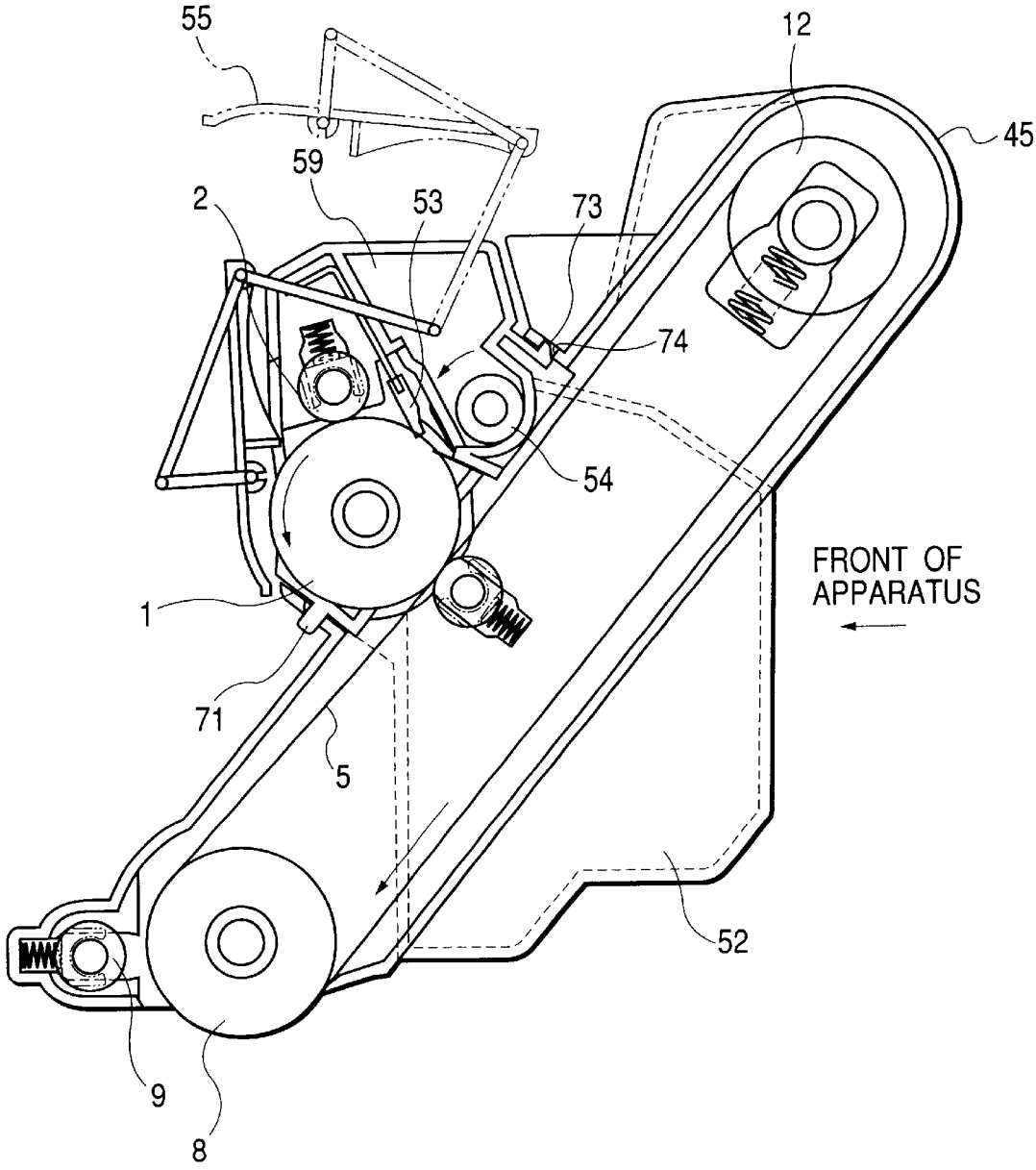
FIG. 3 depicts an intermediate transferring belt-photosensitive drum integrated process cartridge having roller-shaped electric charge providing means.

The obtained intermediate transferring belt was incorporated into an intermediate transferring belt-photosensitive drum integrated process cartridge shown in FIG. 3.

In FIG. 3, the unit construction is roughly divided into two.

Figure 9:
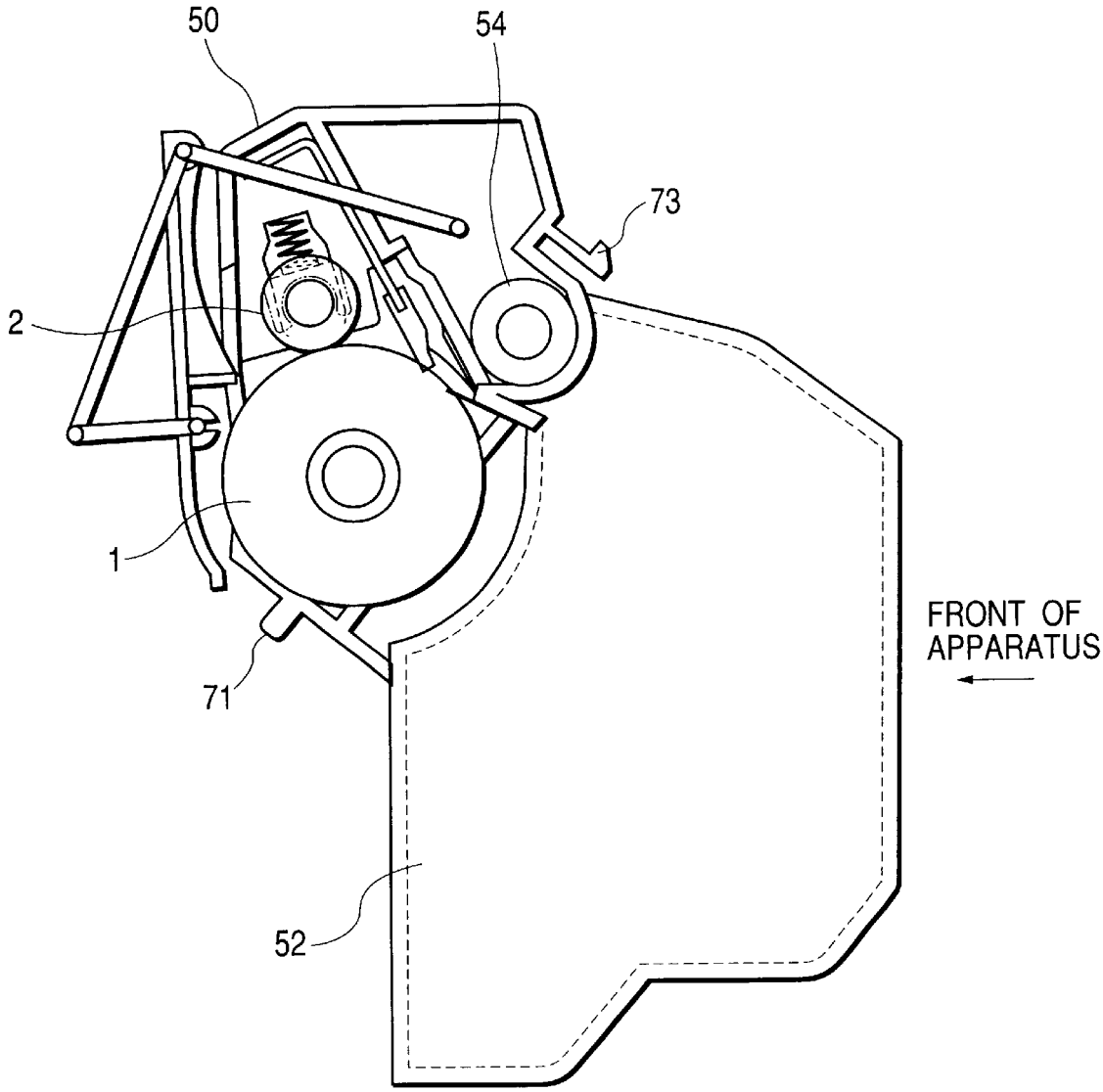
FIG. 9 depicts a photosensitive drum unit of the process cartridge shown in FIG. 3.

One is a photosensitive drum unit 50 shown in FIG. 9.

This is composed of main parts comprising a photosensitive drum frame 59 integrally combined with a waste toner container 52, a photosensitive drum 1, a charging means (charging roller) 2, a photosensitive drum cleaning means (cleaning blade) 53, a screw 54 and a drum shutter 55.

Figure 10:
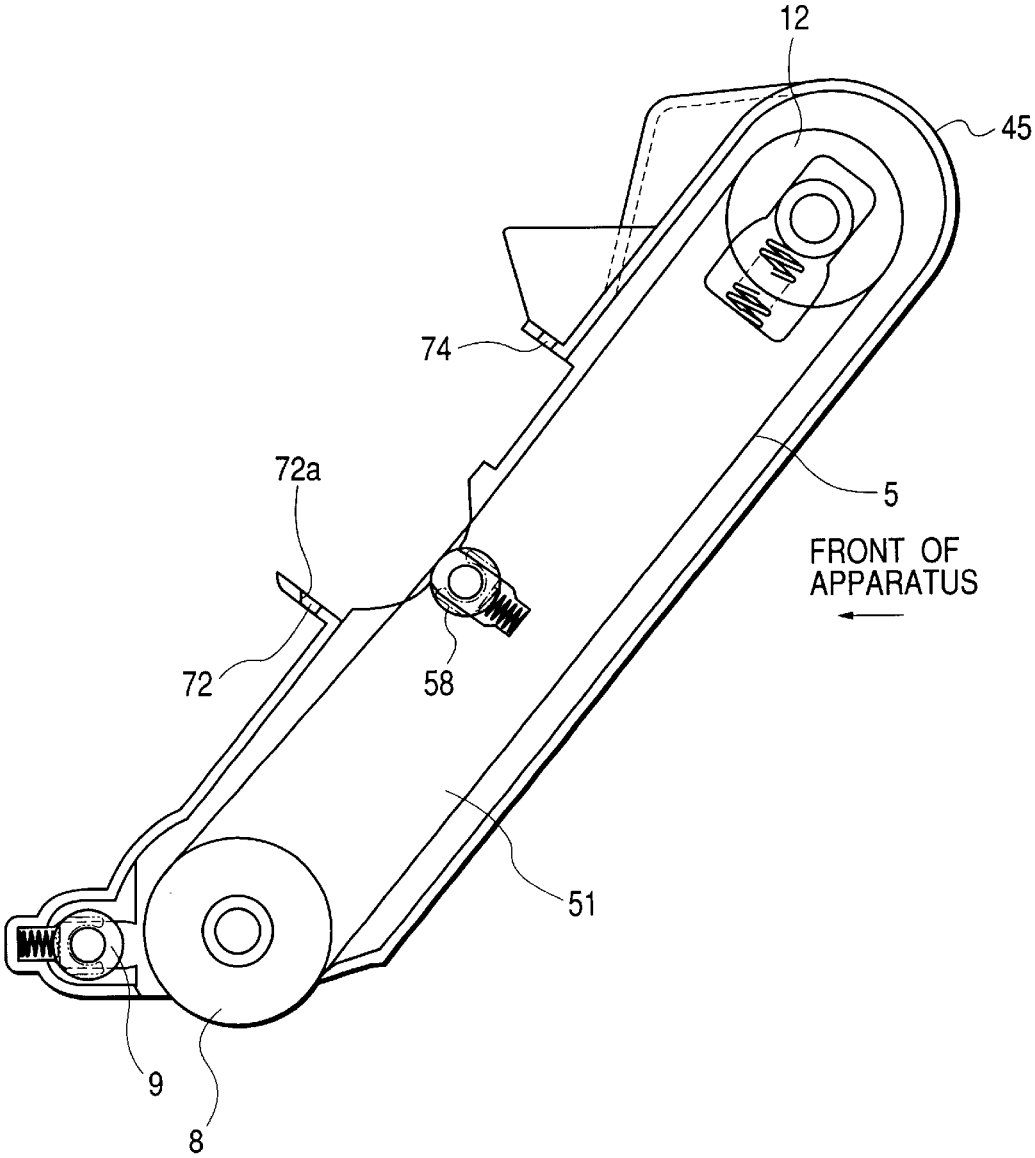
FIG. 10 depicts an intermediate transferring belt unit of the process cartridge shown in FIG. 3.

The other is an intermediate transferring belt unit 51 shown in FIG. 10.

In this unit, an intermediate transferring belt 5 is placed over and around a secondary transferring facing roller 8 and a driven roller 12 along an intermediate transferring belt frame 45, and a primary transferring means (primary transferring roller) 58 is disposed inside the intermediate transferring belt facing the photosensitive drum 1 and an electric charge providing means 9 are disposed beside the secondary transferring facing roller 8. The secondary transferring facing roller 8 also functions as a drive roller to rotate the intermediate transferring belt 5.

As for these two units, protrusions 71 provided at both left and right ends of the photosensitive drum frame 59 are respectively inserted into positioning holes 72 formed in the intermediate transferring belt frame 45, and on the other hand, a hook part nail 73 of a snap fit type provided in the center in the longitudinal direction of the photosensitive drum frame 59 are engaged into a lock hole 74 of the intermediate transferring belt frame 45 for connection.

The positioning holes 72 provided in the intermediate transferring belt frame 45 and the lock hole 74 are provided with holes larger by a predetermined size than the hook part nail 73 and the protrusions 71 provided in the photosensitive drum frame 59, so that relative positional movement is permitted in a predetermined fashion between the photosensitive drum unit 50 and the intermediate transferring belt unit 51.

In addition, the positioning holes 72 are provided with taper parts 72*a* for easy attachment/detachment.

In FIG. 3, the hook part nail 73 of the photosensitive drum unit 50 is pushed so as to be taken off from the lock holes 74 of the intermediate transferring belt unit 51, and the photosensitive drum unit 50 is rotated, and thus as shown in FIG. 9 and FIG. 10, division into the photosensitive drum unit and the intermediate transferring belt unit can be effected.

At the time of connection, contrary to the above, the protrusions 71 of the photosensitive drum unit 50 are inserted into the positioning holes 72 of the intermediate transferring belt unit 51 and rotation in the opposite direction to the case of removal is conducted and the hook part nail 73 is pushed into the lock hole 74 to connect the two units.

Thus, by adopting such a construction that the photosensitive drum unit and the intermediate transferring belt unit can be separated and the connecting means for connecting the photosensitive drum unit and the intermediate transferring belt unit is provided, a user would be able to remove the process cartridge from the electrophotographic apparatus main body and thereafter split the removed process cartridge into the photosensitive drum unit and the intermediate transferring belt unit and replace only the unit having reached the end of its life, so that the cost burden of the user can be alleviated.

The electric charge providing means 9 is brought into contact with an unillustrated feeder plate, and when the process cartridge is incorporated into the image forming apparatus main body, power can be supplied to the electric charge providing means 9 from the image forming apparatus main body through the unillustrated feeder plate, whereby the transferring residual toner on the intermediate transferring belt 5 can be charged to an opposite polarity to the photosensitive member.

After image transfer onto the transferring material P is completed, the electric charge providing means 9 is brought into contact with the intermediate transferring belt 5 which is so disposed as to be freely separated and contacted state and a bias of a polarity reverse to the photosensitive drum 1 is applied so that charges of a polarity reverse to the polarity in the primary transfer are imparted to the transferring residual toner remaining on the intermediate transferring belt 5 without being transferred onto the transferring material P. In this case, a direct current is superimposed on an alternating current and applied.

The above described transferring residual toner charged to a polarity reverse to the polarity in the primary transfer undergoes electrostatic transfer onto the photosensitive drum 1 in the contact part with the photosensitive drum 1 as well as in the vicinity thereof so that the intermediate transferring member is cleaned. Since this step was able to be carried out simultaneously with the primary transfer, reduction in throughput did not occur.

The photosensitive drum is a photosensitive drum with a diameter of 37.5 mm containing a gallium phthalocyanine compound as a charge producing matter, and its substrate is made of an aluminum cylinder with a thickness of 1 mm. The surface roughness Ra of the photosensitive drum is 0.050 μm.

The process cartridge was left standing in the environment of 23° C./55±5% RH for 24 hours, and thereafter, was relocated to a room of low temperature/low humidity (15° C./10% RH) and was immediately attached to the electrophotographic apparatus shown in FIG. 4 which was left standing in advance in the low temperature/low humidity (15° C./10% RH) environment and images were evaluated in three hours after attachment.

When the process cartridge in FIG. 3 was attached to the electrophotographic apparatus shown in FIG. 4, only the upper cap 60 of the electrophotographic apparatus main body was opened and the process cartridge was able to easily be attached and removed as in a conventional monochromatic laser beam printer, and hence maintenance such as jam handling and replacement of process cartridge was easy.

Figure 1:
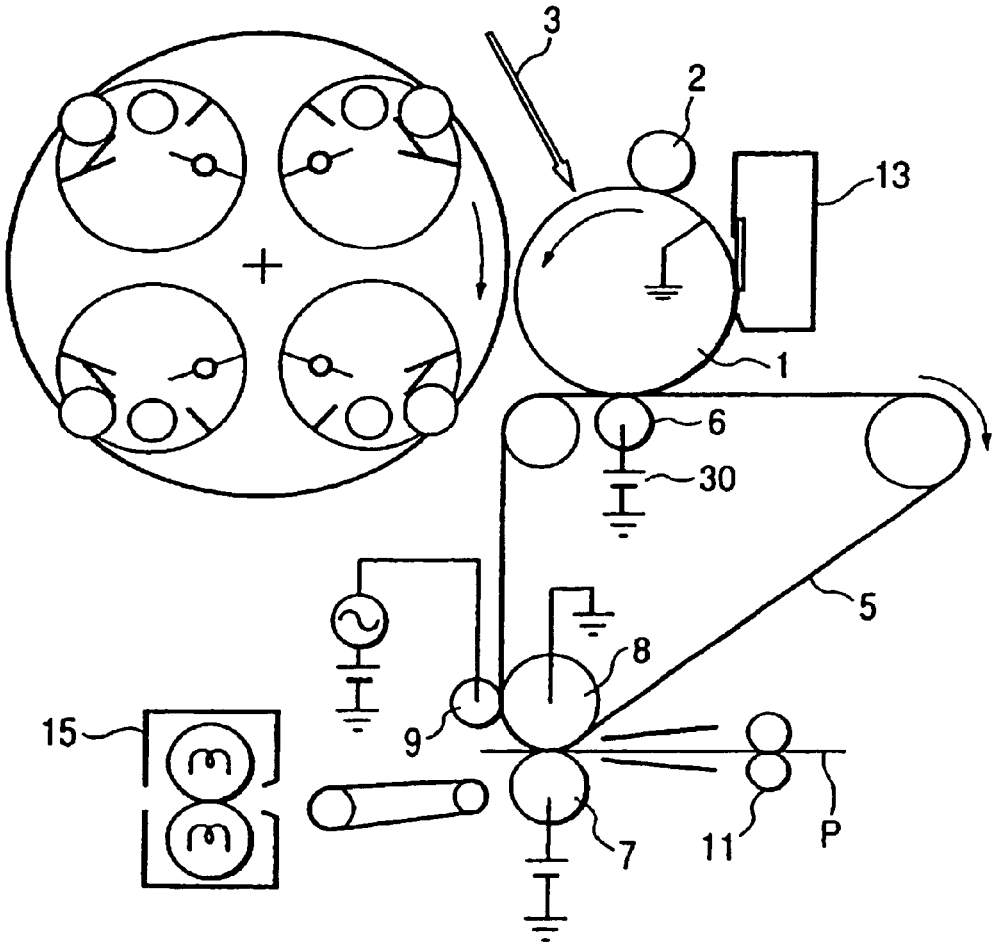
FIG. 1 depicts an electrophotographic apparatus using an intermediate transferring belt.

Although not shown in FIG. 4, a bias power source is in contact with the primary transferring roller 58, the secondary transferring means 7 and the electric charge providing means 9 as in FIG. 1.

The voltage applied to the primary transferring means is around 500 to 3,500 V. The voltage applied to the secondary transferring means 7 is around 1,000 to 3,500 V (constant current control of 10 $\mu$A). A direct current and an alternating current were superimposed and applied to the electric charge providing means.

An evaluation was made of the contact irregularity and coarseness on the basis of the following classification:

AA: do not appear in images at all

A: appear in images to an extremely small extent

B: appear in images to a small extent

C: appear in images a little

D: appear in images

D was judged not to exhibit the effect of the present invention.

The results are shown in Table 1.

EXAMPLE 2

The following materials were mixed by using a double-screw extruder to get pellets.

Polyvinyliden fluoride resin (PVDF) 70% by weight

Polyetheresteramide (conductive agent: Pelestat NC6321: Produced by Sanyo Chemical Industries, Ltd.) 10% by weight Kaolin (primary particle diameter of 2 $\mu$m) 5% by weight Zinc oxide (primary particle diameter of 0.2 $\mu$m) 15% by weight The above described pellet was molded as in Example 1 to obtain an intermediate transferring belt of this Example with a thickness of 100 $\mu$m.

The resistance irregularity of the volume resistivity in the peripheral direction of the obtained belt was 7.5 and the average value of the volume resistivity was $1\times10^{11}$ Ω·cm.

According to the above described measuring method, the moisture amount of the intermediate transferring belt was measured to reveal that the moisture amount was 0.415% by weight. The moisture amount was measured at 130° C.

According to the measuring method described in JIS-K7209, the moisture absorption rate was measured to reveal that the rate was 4.1% by weight.

When measuring the volume resistivity, the moisture amount and the moisture absorption rate, the rib was cut out so as to be excluded from the measuring samples.

With the obtained intermediate transferring belt and the photosensitive drum used in Example 1, the evaluation was made in the same way as in Example 1.

The results are shown in Table 1.

EXAMPLE 3

The following materials were mixed by using a double-screw extruder to get pellets.

Polyvinyliden fluoride resin (PVDF) 65% by weight

Polyetheresteramide (conductive agent: Pelestat NC6321: Produced by Sanyo Chemical Industries, Ltd.) 15% by weight Kaolin (primary particle diameter of 2 $\mu$m) 5% by weight Zinc oxide (primary particle diameter of 0.2 $\mu$m) 15% by weight The above described pellets were molded in the same way as in Example 1 to obtain an intermediate transferring belt of this Example with a thickness of 100 $\mu$m.

The resistance irregularity of the volume resistivity in the peripheral direction of the obtained belt was 8.8 and the average value of the volume resistivity was $3\times10^{10}$ Ω·cm.

According to the above described measuring method, the moisture amount of the intermediate transferring belt was measured to reveal that the moisture amount was 0.452% by weight. The moisture amount was measured at 130° C.

According to the measuring method described in JTS-K7209, the moisture absorption rate was measured to reveal that the rate was 4.4% by weight.

When measuring the volume resistivity, the moisture amount and the moisture absorption rater the rib was cut out so as to be excluded from the measuring samples.

With the obtained intermediate transferring belt and the photosensitive drum used in Example 1, evaluation was made in the same way as in Example 1.

The results are shown in Table 1.

EXAMPLE 4

The following materials were mixed by using a double-screw extruder to get pellets.

Polyvinyliden fluoride resin (PVDF) 60% by weight

Polyetheresteramide (conductive agent: Pelestat NC6321: Produced by Sanyo Chemical Industries, Ltd.) 20% by weight Kaolin (primary particle diameter of 2 $\mu$m) 5% by weight Zinc oxide (primary particle diameter of 0.2 $\mu$M) 15% by weight The above described pellet was molded as in Example 1 to obtain an intermediate transferring belt of this Example with a thickness of 100 $\mu$m.

The resistance irregularity of the volume resistivity in the peripheral direction of the obtained belt was 9.2 and the average value of the volume resistivity was $1\times10^{10}$ Ω·cm.

According to the above described measuring method, the moisture amount of the intermediate transferring belt was measured to reveal that the moisture amount was 0.997% by weight. The moisture amount was measured at 130° C.

According to the measuring method described in JIS-K7209, the moisture absorption rate was measured to reveal that the rate was 4.6% by weight.

When measuring the volume resistivity, the moisture amount and the moisture absorption rate, the rib was cut out so as to be excluded from the measuring samples.

A slight contact irregularity also occurred in the part corresponding to the contact part between the intermediate transferring belt and the electric charge giving means. The reason for this effect is deemed to be that the moisture amount of the intermediate transferring belt in that contact part increased as compared with the other parts, thereby lowering the resistance in the contact part so that the resistance irregularity resulted in irregularity in transferring efficiency to slightly appear in the image.

The results are shown in Table 1.

EXAMPLE 5

For the step of finishing the inner peripheral face, the blast processing was carried out with #100 Carborundum to roughen the inner peripheral face of the stainless cylinder (surface roughness Ra=0.496 μm), and as a result, the surface roughness Ra of the intermediate transferring belt was made to be 0.496 μm, but otherwise, the process cartridge was assembled in the same way as in Example 4, and an image evaluation was made in the same way as in Example 1.

The results are shown in Table 1.

EXAMPLE 6

In the step of finishing the inner peripheral face, the blast processing was carried out with #60 Carborundum to make the inner peripheral face of the cylinder much rougher (surface roughness Ra=0.568 μm) than the stainless cylinder used in Example 5, but otherwise, an intermediate transferring belt was obtained in the same way as in Example 5.

The thickness of the obtained belt was 100 μm and the surface roughness Ra was 0.568 μm.

With the obtained intermediate transferring belt and the photosensitive drum used in Example 1, evaluation was made in the same way as in Example 1.

The results are shown in Table 1.

EXAMPLE 7

The surface of the photosensitive drum was coarse (surface coarseness Ra=0.298 μm), but otherwise, the same photosensitive drum as in Example 1 was used and the intermediate transferring belt produced in Example 4 was used to make an evaluation in the same way as in Example 1.

The results are shown in Table 1.

EXAMPLE 8

Compared with Example 7, the surface of the photosensitive drum was much coarser (Ra=0.371 μm), but otherwise, an evaluation was made in the same way as in Example 7.

The results are shown in Table 1.

EXAMPLE 9

The following materials were mixed by using a double-screw extruder to get pellets.

Polyvinyliden fluoride resin (PVDF) 75% by weight

Polyetheresteramide (conductive agent: Pelestat NC6321: Produced by Sanyo Chemical Industries, Ltd.) 5% by weight Carbon black (conductive agent) 10% by weight Zinc oxide (primary particle diameter of 0.2 μm) 10% by weight The above described pellet was molded as in Example 1 to obtain an intermediate transferring belt of this Example with a thickness of 100 μm.

The resistance irregularity of the volume resistivity in the peripheral direction of the obtained belt was 96 and the average value of the volume resistivity was $4\times10^9$ Ω·cm.

According to the above described measuring method, the moisture amount of the intermediate transferring belt was measured to reveal that the moisture amount was 0.492% by weight. The moisture amount was measured at 130° C.

According to the measuring method described in JIS-K7209, the moisture absorption rate was measured to reveal that the rate was 2.1% by weight.

When measuring the volume resistivity, the moisture amount and the moisture absorption rate, the rib was cut out so as to be excluded from the measuring samples.

With the obtained intermediate transferring belt and the photosensitive drum used in Example 1, an evaluation was made in the same way as in Example 1.

The moisture amount was nearly the same as in Example 3, but the conductive agent was segregated at the part where resistance was low, the moisture amount at that part slightly locally increased, and the resistance irregularity was as large as 96.

However, the occurrence of the contact irregularity was just slight.

The results are shown in Table 1.

EXAMPLE 10

The following materials were mixed by using a double-screw extruder to get pellet.

Polyvinyliden fluoride resin (PVDF) 75% by weight

Polyetheresteramide (conductive agent: Pelestat NC6321: Produced by Sanyo Chemical Industries, Ltd.) 5% by weight Carbon black (conductive agent) 12% by weight Zinc oxide (primary particle diameter of 0.2 μm) 8% by weight The above described pellets were molded in the same way as in Example 1 to obtain an intermediate transferring belt of this Example with a thickness of 100 μm.

The resistance irregularity of the volume resistivity in the peripheral direction of the obtained belt was 215 and the average value of the volume resistivity was $1\times10^9$ Ω·cm. According to the above described measuring method, the moisture amount of the intermediate transferring belt was measured to reveal that the moisture amount was 0.496% by weight. The moisture amount was measured at 130° C.

According to the measuring method described in JIS-K7209, the moisture absorption rate was measured to reveal that the rate was 2.7% by weight.

When measuring the volume resistivity, the moisture amount and the moisture absorption rate, the rib was cut out so as to be excluded from the measuring samples.

With the obtained intermediate transferring belt and the photosensitive drum used in Example 1, an evaluation was made in the same way as in Example 1.

The moisture amount is nearly the same as in Example 3, but the resistance irregularity was as large as 215, and therefore when compared with Example 9, the level of longitudinal line irregularity (banding) got worse a little.

The results are shown in Table 1.

EXAMPLE 11

Figure 5:
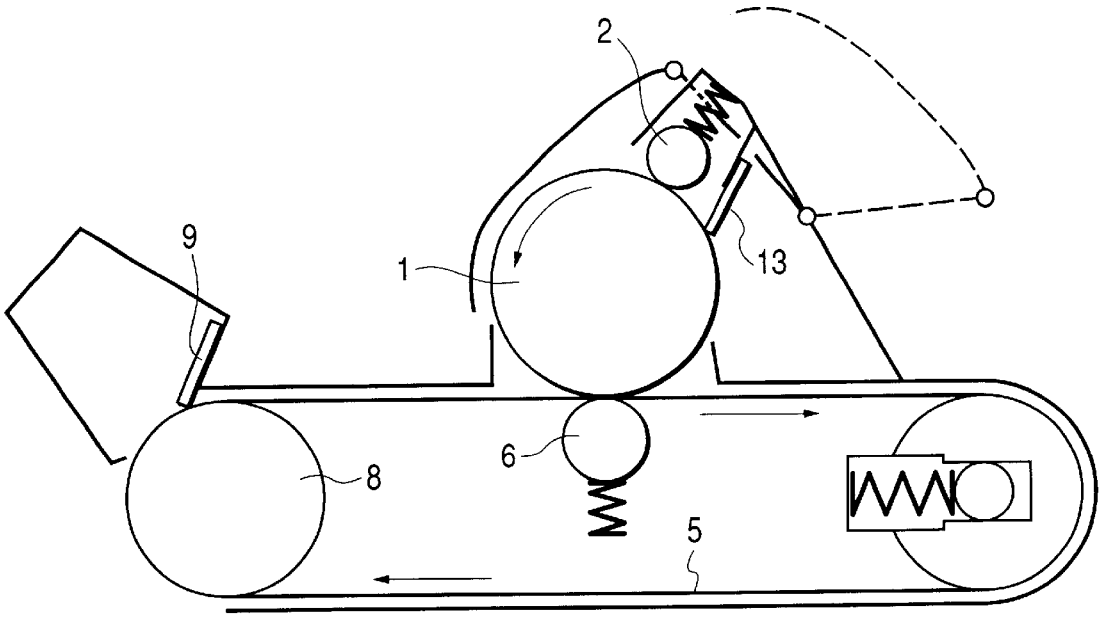
FIG. 5 is an intermediate transferring belt-photosensitive drum integrated process cartridge having blade-shaped electric charge providing means.
Figure 6:
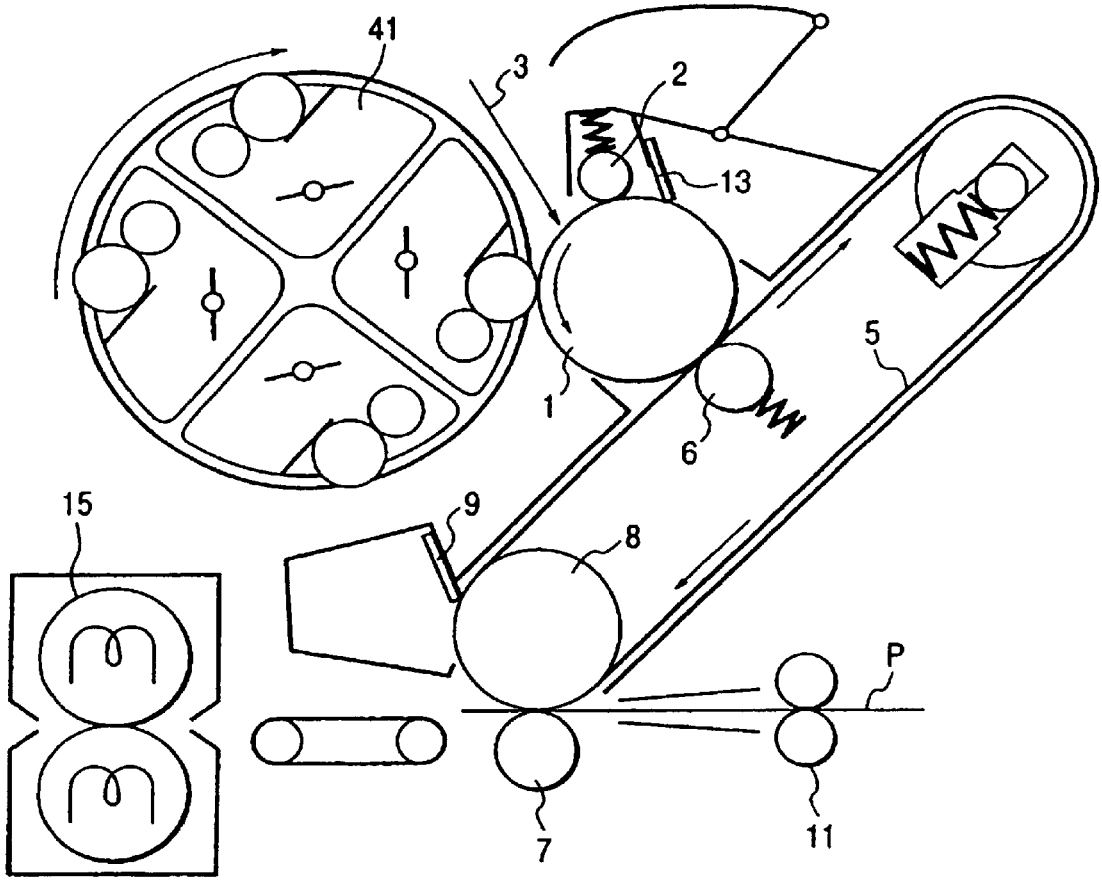
FIG. 6 depicts an electrophotographic apparatus using the process cartridge shown in FIG. 5.

As shown in FIG. 5, an intermediate transferring belt-photosensitive drum integrated process cartridge was assembled in the same way as in Example 4 except that the electric charge providing means was shaped into a blade, not a roller, which was attached to the electrophotographic apparatus shown in FIG. 6 and an image evaluation was made in the same way as in Example 1.

Although not shown in FIG. 6, a bias power source is connected to the primary transferring means 6, the secondary transferring means 7 and the electric charge providing means 9 as in FIG. 1. The voltage applied to the primary transferring means 6 is around 500 to 3,500V. The voltage applied to the secondary transferring means 7 is around 1,000 to 3,500 V (constant current control of 10 μA). A direct current and an alternating currents were superimposed and applied to the electric charge providing means 9.

The contact irregularity between the intermediate transferring belt and the photosensitive drum was in the same level as in Example 4.

In this Example, the electric charge providing means was shaped into a blade. The width of the contact part between the electric charge providing means and the intermediate transferring belt is narrow as compared with Example 4, and no contact irregularity between the intermediate transferring belt and the electric charge providing means was seen.

The present process cartridge required a waste toner box in order to store the transferring residual toner scraped off with the above described blade, and when compared with the process cartridge in the other Examples, became a little larger, and was rather disadvantageous from the miniaturization viewpoint, but was not so large as the process cartridge in the later-described Comparative Example 4.

The results are shown in Table 1.

EXAMPLE 12

The honing processing was carried out with #100 sandpaper to change the roughness of the inner peripheral face of the stainless cylinder (the surface roughness Ra=0.205 μm), so that the surface roughness Ra of the intermediate transferring belt was made to be 0.205 μm, but otherwise, the intermediate transferring belt of this Example with a thickness of 100 μm was obtained in the same way as in Example 1.

The resistance irregularity of the volume resistivity in the peripheral direction of the obtained belt was 6.6 and the average value of the volume resistivity was $2\times10^{11}$ Ω·cm.

According to the above described measuring method, the moisture amount of the intermediate transferring belt was measured to reveal that the moisture amount was 0.225% by weight. The moisture amount was measured at 130° C.

According to the measuring method described in JIS-K7209, the moisture absorption rate was measured to reveal that the rate was 3.6% by weight.

When measuring the volume resistivity, the moisture amount and the moisture absorption rate, the rib was cut out so as to be excluded from the measuring samples.

The obtained intermediate transferring belt was evaluated in the same way as in Example 1.

The results are shown in Table 1.

EXAMPLE 13

The intermediate transferring belt-photosensitive drum integrated process cartridge was assembled with the intermediate transferring belt used in Example 5 and the photosensitive drum used in Example 7, and evaluation was made in the same way as in Example 1.

The results are shown in Table 1.

EXAMPLE 14

The pellets in Example 3 were used to extrude a tube with a thickness of 160 μm in the same way as in Example 1 (provided the inner diameter of the stainless cylinder was 142.43 mm), and the intermediate transferring belt with a thickness of 160 μm was obtained in the same way as in Example 1.

The resistance irregularity of the volume resistivity in the peripheral direction of the obtained belt was 8.8 and the average value of the volume resistivity was $3\times10^{10}$ Ω·cm.

According to the above described measuring method, the moisture amount of the intermediate transferring belt was measured to reveal that the moisture amount was 0.452% by weight. The moisture amount was measured at 130° C.

According to the measuring method described in JIS-K7209, the moisture absorption rate was measured to reveal that the rate was 4.4% by weight.

When measuring the volume resistivity, the moisture amount and the moisture absorption rate, the rib was cut out so as to be excluded from the measuring samples.

The obtained intermediate transferring belt was evaluated in the same way as in Example 1.

Thickness of the belt was a little thicker, and the occurrence of the contact irregularity was just slight.

The results are shown in Table 1.

EXAMPLE 15

The thickness was changed to 200 μm, but otherwise, the intermediate transferring belt with a thickness of 200 μm was obtained in the same way as in Example 14 (provided the inner diameter of the stainless cylinder is 142.51 mm).

The resistance irregularity of the volume resistivity in the peripheral direction of the obtained belt was 8.8 and the average value of the volume resistivity was $3\times10^{10}$ Ω·cm.

According to the above described measuring method, the moisture amount of the intermediate transferring belt was measured to reveal that the moisture amount was 0.452% by weight. The moisture amount was measured at 130° C.

According to the measuring method described in JIS-K7209, the moisture absorption rate was measured to reveal that the rate was 4.4% by weight.

When measuring the volume resistivity, the moisture amount and the moisture absorption rate, the rib was cut out so as to be excluded from the measuring samples.

The obtained intermediate transferring belt was evaluated in the same way as in Example 1.

Thickness of the belt was a little thick, and a little contact irregularity was seen.

The results are shown in Table 1.

EXAMPLE 16

The pellets in Example 2 was used and the apparatus in FIG. 2 as in Example 1 was used, and a tube with a thickness of 80 μm was obtained by inflation molding. Next, a stainless cylinder whose inner peripheral face was carefully polished (electropolishing after buffing) was used, but otherwise, the intermediate transferring belt was obtained in the same way as in Example 1.

The thickness of the obtained intermediate transferring belt was 80 μm.

The resistance irregularity of the volume resistivity in the peripheral direction of the obtained belt was 7.5 and the average value of the volume resistivity was $1\times10^{11}$ Ω·cm.

According to the above described measuring method, the moisture amount of the intermediate transferring belt was measured to reveal that the moisture amount was 0.415% by weight. The moisture amount was measured at 130° C.

According to the measuring method described in JIS-K7209, the moisture absorption rate was measured to reveal that the rate was 4.1% by weight.

When measuring the volume resistivity, the moisture amount and the moisture absorption rate, the rib was cut out so as to be excluded from the measuring samples.

Using the same photosensitive drum as in Example 1 with the exception of its surface roughness (Ra=0.031 μm), and the intermediate transferring belt of the present Example, an evaluation was made in the same way as Example 1.

The results are shown in Table 1.

EXAMPLE 17

The following materials were mixed by using a double-screw extruder to get pellets.

Polyvinyliden fluoride resin (PVDF) 83% by weight

Polyetheresteramide (conductive agent: Pelestat NC6321: Produced by Sanyo Chemical Industries, Ltd.) 2% by weight Zinc oxide (primary particle diameter of 0.2 μm) 15% by weight The above described pellets were molded in the same way as in Example 1 to obtain an intermediate transferring belt of this Example with a thickness of 100 μm.

The resistance irregularity of the volume resistivity in the peripheral direction of the obtained belt was 3.6 and the average value of the volume resistivity was $8\times10^{13}$ Ω·cm.

According to the above described measuring method, the moisture amount of the intermediate transferring belt was measured to reveal that the moisture amount was 0.085% by weight. The moisture amount was measured at 130° C.

According to the measuring method described in JIS-K7209, the moisture absorption rate was measured to reveal that the rate was 1.3% by weight.

When measuring the volume resistivity, the moisture amount and the moisture absorption rate, the rib was cut out so as to be excluded from the measuring samples.

Using the obtained intermediate transferring belt and the photosensitive drum used in Example 1, an evaluation was made in the same way as in Example 1.

The results are shown in Table 1.

COMPARATIVE EXAMPLE 1

The following materials were mixed by using a double-screw extruder to get pellets.

Polyvinyliden fluoride resin (PVDF) 64% by weight

Polyetheresteramide (conductive agent: Pelestat NC6321: Produced by Sanyo Chemical Industries, Ltd.) 18% by weight Lithium fluoroborate (conductive agent) 1% by weight Zinc oxide (primary particle diameter of 0.2 μm) 17% by weight The above described pellets were molded in the same way as in Example 1 to obtain an intermediate transferring belt of the present Comparative Example with thickness of 100 μm.

The resistance irregularity of the volume resistivity in the peripheral direction of the obtained belt was 9.5 and the average value of the volume resistivity was $1\times10^{10}$ Ω·cm.

According to the above described measuring method, the moisture amount of the intermediate transferring belt was measured to reveal that the moisture amount was 1.124% by weight. The moisture amount was measured at 130° C.

According to the measuring method described in JIS-K7209, the moisture absorption rate was measured to reveal that the rate was 4.6% by weight.

When measuring the volume resistivity, the moisture amount and the moisture absorption rate, the rib was cut out so as to be excluded from the measuring samples.

The obtained intermediate transferring belt was evaluated as in Example 1.

The results are shown in Table 1.

COMPARATIVE EXAMPLE 2

The inner peripheral face of the stainless cylinder was roughened (surface roughness Ra=0.568 μm), and as a result, the Ra of the surface of the intermediate transferring belt was made to be 0.568 μm, but otherwise, the intermediate transferring belt with a thickness of 100 μm was obtained in the same way as in Example 4.

The resistance irregularity of the volume resistivity in the peripheral direction of the obtained belt was 9.2 and the average value of the volume resistivity was $1\times10^{10}$ Ω·cm.

According to the above described measuring method, the moisture amount of the intermediate transferring belt was measured to reveal that the moisture amount was 0.997% by weight. The moisture amount was measured at 130° C.

According to the measuring method described in JIS-K7209, the moisture absorption rate was measured to reveal that the rate was 4.6% by weight.

When measuring the volume resistivity, the moisture amount and the moisture absorption rate, the rib was cut out so as to be excluded from the measuring samples.

The obtained intermediate transferring belt and the photosensitive drum used in Example 7 were used and an evaluation was made in the same way as in Example 1.

Since the surface of the intermediate transferring belt was rough, the level of the contact irregularity was apparently good as compared with the evaluation result in Example 4, and no contact irregularity occurred in the part corresponding to the contact part between the intermediate transferring belt and the electric charge providing means, but the coarseness was noticeable.

The results are shown in Table 1.

COMPARATIVE EXAMPLE 3

The following materials were mixed by using a double-screw extruder to get pellets.

Polyvinyliden fluoride resin (PVDF) 68% by weight

Polyether (conductive agent: aquacoke: Produced by Sumitomo Seika Chemicals Co., Ltd.) 14% by weight Lithium fluoroborate (conductive agent) 1% by weight Zinc oxide (primary particle diameter of 0.2 μm) 17% by weight The above described pellets were molded in the same way as in Example 1 to obtain an intermediate transferring belt with a thickness of 100 μm.

The resistance irregularity of the volume resistivity in the peripheral direction of the obtained belt was 9.3 and the average value of the volume resistivity was $3\times10^{9}$ Ω·cm.

According to the above described measuring method, the moisture amount of the intermediate transferring belt was measured to reveal that the moisture amount was 1.215% by weight. Measurement of the moisture amount was measured at 130° C.

According to the measuring method described in JIS-K7209, the moisture absorption rate was measured to reveal that the rate was 5.6% by weight.

When measuring the volume resistivity, the moisture amount and the moisture absorption rate, the rib was cut out so as to be excluded from the measuring samples.

The obtained intermediate transferring belt was evaluated in the same way as in Example 1.

Since the moisture amount was not less than 1% by weight, the contact irregularity occurred. In addition, also in the part corresponding to the contact part between the intermediate transferring belt and the electric charge providing means, a slight contact irregularity occurred.

The results are shown in Table 1.

COMPARATIVE EXAMPLE 4

Figure 7:
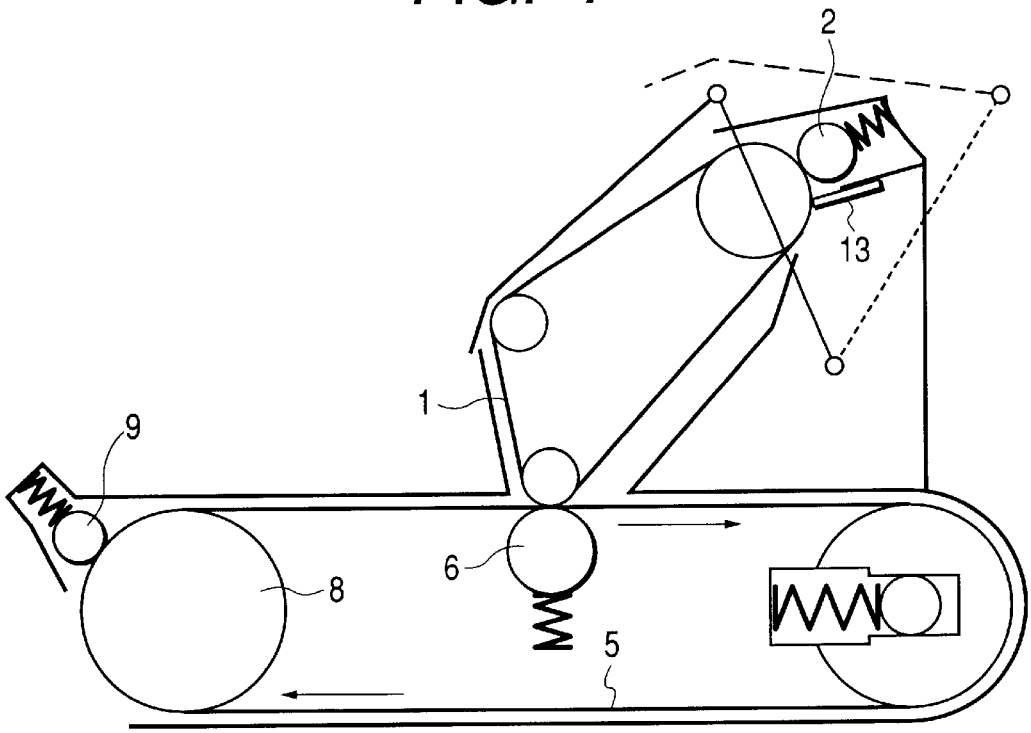
FIG. 7 depicts an intermediate transferring belt-photosensitive belt integrated process cartridge.
Figure 8:
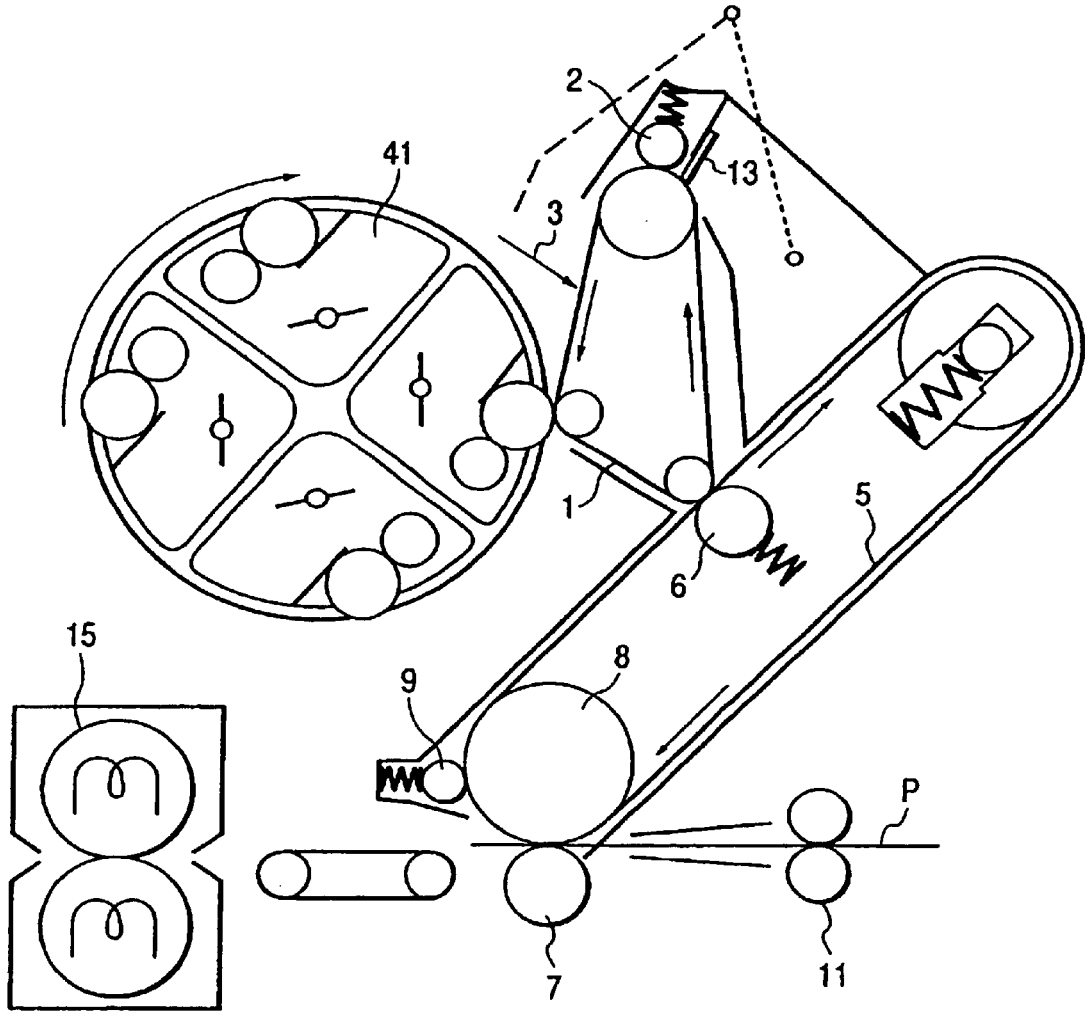
FIG. 8 depicts an electrophotographic apparatus using the process cartridge shown in FIG. 7.

The intermediate transferring belt and the photosensitive belt obtained in Example 4 were incorporated into the all-in-one process cartridge as shown in FIG. 7, then the cartridge was attached to the electrophotographic apparatus as shown in FIG. 8, and an evaluation was made in the same way as in Example 1.

Although not shown in FIG. 8, a bias power source was connected to the primary transferring means 6, the secondary transferring means 7 and the electric charge providing means 9 as shown in FIG. 1. The voltage applied to the primary transferring means 6 was around 500 to 3,500 V. The voltage applied to the secondary transferring means 7 was around 1,000 to 3,500 V (constant current control of 10 μA). A direct current and an alternate current were superimposed and applied to the electric charge providing means 9.

The photosensitive belt has a surface roughness Ra of 0.050 μm, and as the substrate of the photosensitive belt used in this Comparative Example, used was a polyethylene telephtalate film with a thickness of 70 μm on which an aluminum evaporation film with a thickness of 100 nm was, with a gallium phthalocyanine compound being contained as an electric charge producing matter.

In this Comparative Example, since the electrophotographic photosensitive member was shaped into a belt, no contact irregularity occurred. In the contact part between the photosensitive belt and the intermediate transferring belt, a grounded roller was placed on the rear face of the photosensitive belt, and hence the moisture seemed not to be able to escape easily.

However, since no contact irregularity occurred, the moisture was deemed to be released through the base layer (polyethylenphtalate) of the photosensitive belt.

This Comparative Example had such an advantage that no contact irregularity was seen, but since the process cartridge became large, the replacement workability of the process cartridge was apparently inferior to Example 1.

In addition, it is difficult to drive the photosensitive belt at a constant speed, and the half-tone image lacked uniformity in comparison with the Examples of the present invention using a photosensitive drum. Periodical transverse lines (banding) were seen.

The results are shown in Table 1.

TABLE 1

| | Surface roughness of intermediate transferring belt Ra (μm) | Surface roughness of photosensitive drum Ra (μm) | Sum of Ra | Moisture amount of intermediate transferring belt (%) | Moisture absorption rate of intermediate transferring belt (%) | Resistance irregularity of volume resistance rate of intermediate transferring belt | Contact irregularity | Coarseness |
|---|---|---|---|---|---|---|---|---|
| Example 1 | 0.123 | 0.050 | 0.173 | 0.225 | 3.6 | 6.6 | AA | AA |
| Example 2 | 0.123 | 0.050 | 0.173 | 0.415 | 4.1 | 7.5 | AA | AA |
| Example 3 | 0.123 | 0.050 | 0.173 | 0.452 | 4.4 | 8.8 | B | AA |
| Example 4 | 0.123 | 0.050 | 0.173 | 0.997 | 4.6 | 9.2 | C | AA |
| Example 5 | 0.496 | 0.050 | 0.546 | 0.997 | 4.6 | 9.2 | A | B |
| Example 6 | 0.568 | 0.050 | 0.618 | 0.997 | 4.6 | 9.2 | A | C |
| Example 7 | 0.123 | 0.298 | 0.421 | 0.997 | 4.6 | 9.2 | A | A |
| Example 8 | 0.123 | 0.371 | 0.494 | 0.997 | 4.6 | 9.2 | A | B |
| Example 9 | 0.125 | 0.050 | 0.175 | 0.492 | 2.1 | 96 | B | AA |
| Example 10 | 0.126 | 0.050 | 0.176 | 0.496 | 2.7 | 215 | C | AA |
| Example 11 | 0.123 | 0.050 | 0.173 | 0.997 | 4.6 | 9.2 | C | AA |
| Example 12 | 0.205 | 0.050 | 0.255 | 0.225 | 3.6 | 6.6 | A | A |
| Example 13 | 0.496 | 0.298 | 0.794 | 0.997 | 4.6 | 9.2 | A | C |
| Example 14 | 0.123 | 0.050 | 0.173 | 0.452 | 4.4 | 8.8 | B | AA |
| Example 15 | 0.123 | 0.050 | 0.173 | 0.452 | 4.4 | 8.8 | C | AA |
| Example 16 | 0.010 | 0.031 | 0.041 | 0.415 | 4.1 | 7.5 | A | AA |
| Example 17 | 0.123 | 0.050 | 0.173 | 0.085 | 1.3 | 3.6 | A | AA |
| Comparative Example 1 | 0.123 | 0.050 | 0.173 | 1.124 | 4.6 | 9.5 | D | AA |
| Comparative Example 2 | 0.568 | 0.298 | 0.866 | 0.997 | 4.6 | 9.2 | A | D |
| Comparative Example 3 | 0.123 | 0.050 | 0.173 | 1.215 | 5.6 | 9.3 | D | AA |
| Comparative Example 4 | 0.123 | 0.050 (Belt) | 0.173 | 0.997 | 4.6 | 9.2 | B | AA |

As having been described so far, according to the present invention, it has become possible to provide a process cartridge comprising an intermediate transferring belt and a photosensitive drum which are integrally held together to form one unit, which is more compact, and does not bring about image defects such as banding or coarseness, prevents contact irregularity from occurring and can form images with uniform density, an electrophotographic apparatus having the process cartridge and an image forming method using the electrophotographic apparatus.

What is claimed is:

1. A process cartridge detachably mountable on the main body of an electrophotographic apparatus, comprising:

a photosensitive drum configured and positioned to bear a toner image; and an intermediate transferring belt having a contact part in contact with said photosensitive drum, wherein said photosensitive drum and said intermediate transferring belt are integrally held together, wherein the moisture amount of the intermediate transferring belt at 23° C./50% RH is less than 1% by weight, and the sum of the surface roughness Ra of said photosensitive drum and the surface roughness Ra of said intermediate transferring belt is less than 0.8 μm.

2. The process cartridge according to claim 1, further comprising:

primary transferring means for primarily transferring the toner image at said contact part between said photosensitive drum and said intermediate transferring belt from said photosensitive drum to said intermediate transferring belt;

an electric charge providing means for providing electric charges of a polarity opposite to the polarity of the toner at the time of the primary transfer to the toner on said intermediate transferring belt, returning the toner on said intermediate transferring belt to said photosensitive drum at said contact part, and cleaning said intermediate transferring belt; and photosensitive drum cleaning means for cleaning said photosensitive drum, wherein said process cartridge integrally holds said photosensitive drum, said intermediate transferring belt, said primary transferring means, and said electric charge providing means, wherein said process cartridge is separable into a photosensitive drum unit having said photosensitive drum and an intermediate transferring belt unit having said intermediate transferring belt, and wherein said process cartridge further comprises connecting means for connecting said photosensitive drum unit and said intermediate transferring belt unit.

3. The process cartridge according to claim 1, wherein the surface roughness Ra of said intermediate transferring belt is less than 0.5 μm.

4. The process cartridge according to claim 1, wherein the resistance irregularity of the volume resistivity in the peripheral direction of said intermediate transferring belt is less than 100.

5. The process cartridge according to claim 1, wherein the surface roughness Ra of said intermediate transferring belt is 0.03 to 0.2 μm;

the sum of the surface roughness Ra of said photosensitive drum and the surface roughness Ra of said intermediate transferring belt is 0.05 to 0.25 μm;

the surface roughness Ra of said intermediate transferring belt is larger than the surface roughness Ra of said photosensitive drum;

the moisture amount of said intermediate transferring belt at 23° C./50% RH is 0 to 0.45% by weight;

the moisture absorption rate of said intermediate transferring belt is 0 to 4.1%, and the resistance irregularity of the volume resistance rate in the peripheral direction of said intermediate transferring belt is 1 to 7.5.

6. An electrophotographic apparatus comprising:

a photosensitive drum configured and positioned to bear a toner image;

charging means for charging said photosensitive drum;

exposing means for forming an electrostatic latent image on said photosensitive drum charged with said charging means;

developing means for developing with a toner the electrostatic latent image formed on said photosensitive drum with said exposing means and forming a toner image onto said photosensitive drum;

an intermediate transferring belt having a contact part in contact with said photosensitive drum for secondarily transferring onto a transfer medium the toner image having been transferred from said photosensitive drum;

primary transferring means for primarily transferring the toner image from said photosensitive drum to said intermediate transferring belt at said contact part; and a process cartridge which integrally supports at least said photosensitive drum and said intermediate transferring belt and is detachably mountable on a main body of said electrophotographic apparatus, wherein the moisture amount of the intermediate transferring belt at 23° C./50% RH is less than 1% by weight, and the sum of the surface roughness Ra of said photosensitive drum and the surface roughness Ra of said intermediate transferring belt is less than 0.8 μm.

7. The electrophotographic apparatus according to claim 6, wherein said primary transferring means is for primarily transferring the toner image at said contact part between said photosensitive drum and said intermediate transferring belt from said photosensitive drum to said intermediate transferring belt, wherein said process cartridge integrally holds:

said photosensitive drum;

said intermediate transferring belt;

said primary transferring means;

electric charge providing means for providing electric charges of a polarity opposite to the polarity of the toner at the time of the primary transfer to the toner on said intermediate transferring belt, returning the toner on said intermediate transferring belt to said photosensitive drum at said contact part, and cleaning said intermediate transferring belt; and a photosensitive drum cleaning means for cleaning said photosensitive drum, wherein said process cartridge is separable into a photosensitive drum unit having said photosensitive drum and an intermediate transferring belt unit having said intermediate transferring belt, and wherein said process cartridge further comprises connecting means for connecting said photosensitive drum unit and said intermediate transferring belt unit.

8. The electrophotographic apparatus according to claim 6, wherein the surface roughness Ra of said intermediate transferring belt is less than 0.5 μm.

9. The electrophotographic apparatus according to claim 6, wherein the resistance irregularity of the volume resistivity in the peripheral direction of said intermediate transferring belt is less than 100.

10. The electrophotographic apparatus according to claim 6, wherein the surface roughness Ra of said intermediate transferring belt is 0.03 to 0.2 μm;

the sum of the surface roughness Ra of said photosensitive drum and the surface roughness Ra of said intermediate transferring belt is 0.05 to 0.25 μm;

the surface roughness Ra of said intermediate transferring belt is larger than the surface roughness Ra of said photosensitive drum;

the moisture amount of said intermediate transferring belt at 23° C./50% RH is 0 to 0.45% by weight;

the moisture absorption rate of said intermediate transferring belt is 0 to 4.1%, and the resistance irregularity of the volume resistivity in the peripheral direction of said intermediate transferring belt is 1 to 7.5.

11. An image forming method comprising:

a charging step of charging a photosensitive drum;

an exposing step of forming an electrostatic latent image on the photosensitive drum charged in said charging step;

a developing step of developing the electrostatic latent image formed on the photosensitive drum in said exposing step with a toner to form a toner image onto the photosensitive drum;

a primary transferring step of primarily transferring the toner image formed in said developing step with a primary transferring means from the photosensitive drum to the intermediate transferring belt having a contact part with the photosensitive drum; and a secondary transferring step of secondarily transferring the toner image primarily transferred in said primary transferring step onto a transferring material; and using an electrophotographic apparatus having a process cartridge which integrally holds at least the photosensitive drum and the intermediate transferring belt and is detachably mountable on the main body of the electrophotographic apparatus, wherein the moisture amount of the intermediate transferring belt at 23° C./50% RH is less than 1% by weight, and the sum of the surface roughness Ra of the photosensitive drum and the surface roughness Ra of the intermediate transferring belt is less than 0.8 $\mu$m.

12. An image forming method according to claim 11, further comprising:

an electric charge providing step of providing electric charges of a polarity opposite to the polarity of the toner at the time of said primary transferring step to the toner on the intermediate transferring belt with an electric charge providing means;

an intermediate transferring belt cleaning step of returning the toner on the intermediate transferring belt to the photosensitive drum at the contact part between the photosensitive drum and the intermediate transferring belt and cleaning the intermediate transferring belt; and a photosensitive drum cleaning step of cleaning the photosensitive drum, wherein the process cartridge integrally holds the photosensitive drum, the intermediate transferring belt, the primary transferring means, the electric charge providing means, and a photosensitive drum cleaning means for cleaning the photosensitive drum, wherein the process cartridge is separable into a photosensitive drum unit having the photosensitive drum and an intermediate transferring belt unit having the intermediate transferring belt, and wherein the process cartridge further comprises connecting means for connecting the photosensitive drum unit and the intermediate transferring belt unit.

13. An image forming method according to claim 11, wherein the surface roughness Ra of the intermediate transferring belt is less than 0.5 $\mu$m.

14. An image forming method according to claim 11, wherein the resistance irregularity of the volume resistance rate in the peripheral direction of the intermediate transferring belt is less than 100.

15. An image forming method according to claim 11, wherein:

the surface roughness Ra of the intermediate transferring belt is 0.03 to 0.2 $\mu$m;

the sum of the surface roughness Ra of the photosensitive drum and the surface roughness Ra of the intermediate transferring belt is 0.05 to 0.25 $\mu$m;

the surface roughness Ra of the intermediate transferring belt is larger than the surface roughness Ra of the photosensitive drum;

the moisture amount of the intermediate transferring belt at 23° C./50% RH is 0 to 0.45% by weight;

the moisture absorption rate of the intermediate transferring belt is 0 to 4.1%; and the resistance irregularity of the volume resistivity in the peripheral direction of intermediate transferring belt is 1 to 7.5.

* * * * *

UNITED STATES PATENT AND TRADEMARK OFFICE

CERTIFICATE OF CORRECTION

PATENT NO. : 6,766,127 B2
DATED : July 20, 2004
INVENTOR(S) : Atsushi Tanaka et al.

It is certified that error appears in the above-identified patent and that said Letters Patent is hereby corrected as shown below:

Title page,
Item [56], References Cited, FOREIGN PATENT DOCUMENTS,
"07210009" should read -- 7-210009 --.
"08160763" should read -- 8-160763 --.
"2000137388" should read -- 2000-137388 --.

Column 4,
Line 3, "comprising" should read -- comprising: --.

Column 5,
Line 44, "changes" should read -- change --.

Column 6,
Line 31, "from" should be deleted.

Column 7,
Line 25, "coaseness," should read -- coarseness, --.
Line 29, "need" should read -- needs --.
Line 36, "coaseness," should read -- coarseness, --.
Line 58, Close up the left margin.

Column 8,
Line 2, "24-hour" should read -- 24 hours --.
Line 67, "3087723" should read -- 3-87723 --.

Column 12,
Line 33, "from." should read -- form. --.
Line 21, "Polyvinyliden" should read -- polyvinylidene --.

Column 15,
Line 31, "Polyvinyliden" should read -- polyvinylidene --. (both occurrences)
Line 64, "Polyvinyliden" should read -- polyvinylidene --.

Column 16,
Line 29, "Polyvinyliden" should read -- polyvinylidene --.

Column 17,
Line 45, "Polyvinyliden" should read -- polyvinylidene --.

UNITED STATES PATENT AND TRADEMARK OFFICE

CERTIFICATE OF CORRECTION

PATENT NO. : 6,766,127 B2
DATED : July 20, 2004
INVENTOR(S) : Atsushi Tanaka et al.

It is certified that error appears in the above-identified patent and that said Letters Patent is hereby corrected as shown below:

Column 18,
Line 17, "Polyvinyliden" should read -- polyvinylidene --.

Column 21,
Lines 8 and 39, "Polyvinyliden" should read -- polyvinylidene --.

Column 22,
Line 39, "Polyvinyliden" should read -- polyvinylidene --.

Column 24,
Line 17, "Periodical" should read -- Periodic --.

Column 26,
Lines 53 and 61, Close up the right margin.

Signed and Sealed this

Fourth Day of January, 2005

JON W. DUDAS
*Director of the United States Patent and Trademark Office*